US007195814B2

(12) United States Patent
Ista et al.

(10) Patent No.: US 7,195,814 B2
(45) Date of Patent: Mar. 27, 2007

(54) MICROFIBER-ENTANGLED PRODUCTS AND RELATED METHODS

(75) Inventors: Troy K. Ista, River Falls, WI (US); Mario A. Perez, Burnsville, MN (US); Stephen M. Sanocki, Stillwater, MN (US); Michael D. Swan, St. Germain en Laye (FR)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/858,273

(22) Filed: May 15, 2001

(65) Prior Publication Data

US 2002/0187329 A1 Dec. 12, 2002

(51) Int. Cl.
*D04H 5/00* (2006.01)

(52) U.S. Cl. ..... 428/292.1; 428/293.7; 428/359; 428/397; 428/360; 428/365; 428/401

(58) Field of Classification Search ..... 428/359, 428/370, 397, 399, 292.1, 293.7, 360, 365, 428/401, 297.4, 298.1, 364, 369
See application file for complete search history.

(56) References Cited

U.S. PATENT DOCUMENTS

| | | | | |
|---|---|---|---|---|
| 3,458,387 | A | | 7/1969 | Suskind et al. |
| 3,542,632 | A | | 11/1970 | Eickhoff |
| 4,146,663 | A | * | 3/1979 | Ikeda et al. |

(Continued)

FOREIGN PATENT DOCUMENTS

| | | | |
|---|---|---|---|
| EP | 0 365 293 | A2 | 4/1990 |
| EP | 0 940 499 | A2 | 9/1999 |
| EP | 1 091 042 | A1 | 4/2001 |
| GB | 2 108 045 | A | 5/1983 |
| JP | 61-258060 | | 11/1986 |
| JP | 63-85154 | | 4/1988 |
| JP | 4-263660 | | 9/1992 |
| WO | WO 99/61520 | | 12/1999 |
| WO | WO 00/46435 | | 8/2000 |
| WO | WO 00/68301 | | 11/2000 |
| WO | WO 01/96101 | A1 | 12/2001 |
| WO | WO 02/052076 | A1 | 7/2002 |

OTHER PUBLICATIONS

Roger S. Porter and Li–Hui Wang, "*Uniaxial Extension and Order Development in Flexible Chain Polymers*", Journal of Macromolecular Science–Rev. Macromol. Chem. Phys., C35(1), pp. 63–115 (1995).
Jones, et al., "*Crystalline Forms of Isotactic Polypropylene*", Makromol. Chem., vol. 75, pp. 134–158 (1964).
J. Karger–Kocsis, Polypropylene: Structure, Blends and Composites, vol. 1, 130–131(1994).
The 29$^{th}$ Clemson Nonwoven Fabrics Forum, Jun. 22–25, 1998, pp. 1–16.
The Nonwoven Fabrics Handbook, pp. 59–62, 87–88, & 98.
Essentials of Textiles, Holt, Rinehart and Winston, Inc., 4$^{th}$ Ed., "*Other Fabric–Construction Processes*", pp. 235–238.
U.S.S.N. 09/602,978, filed Jun. 23, 2000, "Fibrilalted Article and Method of Making", pp. 1–29 (4 sheets of drawings).
U.S.S.N. 09/858,253, filed May 15, 2001, "Fibrous Films and Articles from Microlayer Substrates", pp. 1–31.
U.S.S.N. 09/865,777, filed May 25, 2001, "Method for Imparting Soil and Stain Resistance to Carpet", pp. 1.–53.

*Primary Examiner*—Merrick Dixon
(74) *Attorney, Agent, or Firm*—Kent S. Kokko

(57) ABSTRACT

Described are microfiber-entangled products and methods of producing microfiber-entangled products from microfiber materials or microfiber-forming materials, the microfiber entangled products having various useful product constructions that incorporate microfiber materials and other materials that can be combined by folding, weaving, lapping, twisting, tying, braiding, or otherwise.

22 Claims, 18 Drawing Sheets

U.S. PATENT DOCUMENTS

| | | | | |
|---|---|---|---|---|
| 4,514,455 | A | | 4/1985 | Hwang |
| H90 | H | | 7/1986 | Kumar |
| 4,973,503 | A | | 11/1990 | Hotchkiss |
| 5,269,995 | A | | 12/1993 | Ramanathan et al. |
| 5,366,362 | A | | 11/1994 | Kumar et al. |
| 6,071,651 | A | | 6/2000 | Forte et al. |
| 6,101,032 | A | | 8/2000 | Wortman et al. |
| 6,110,588 | A | * | 8/2000 | Perez et al. |
| 6,124,971 | A | | 9/2000 | Ouderkirk et al. |
| 6,225,403 | B1 | | 5/2001 | Knowlton |
| 2001/0031594 | A1 | | 10/2001 | Perez et al. |

* cited by examiner

MICROFIBER-ENTANGLED PRODUCTS AND RELATED METHODS

FIELD OF THE INVENTION

The invention relates to various microfiber-entangled products prepared from microfiber materials or microfiber-forming materials, and methods of preparing microfiber-entangled products.

BACKGROUND

Polymeric materials that can be processed to form microfiber surfaces and microfiber-entangled products have been identified, including mono-axially oriented films such as polypropylene, among various others. See U.S. Pat. No. 6,110,588. Such polymeric materials can be selected and processed using various techniques to produce mono-axially oriented films capable of being microfibrillated to a microfiber surface.

There continues to exist a need for new and creative product constructions that can be prepared by combining microfiber materials with other microfiber materials, or by combining microfiber materials with other non-microfiber materials, in different ways, and methods to prepare such product constructions.

Figure 1:
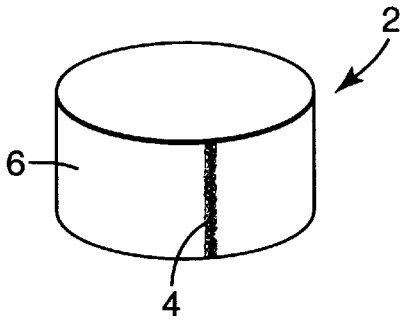
FIG. 1 illustrates an example of a three-dimension microfiber-entangled product.

All drawn figures are not drawn to scale.

SUMMARY OF THE INVENTION

The invention contemplates microfiber-entangled products made from microfiber materials and microfiber-forming materials by physically contacting and commingling, i.e., entangling, microfibers of a microfiber material or a microfiber-forming material (upon formation) with another similar or dissimilar material (a "second material"). The different materials can be contacted and included in a single microfiber-entangled product by folding, weaving, twisting, mending, entwining, or otherwise contacting, combining, or incorporating a microfiber material or a microfiber-forming material with another material.

The microfiber material can be the result of microfibrillating a microfiber-forming material such as a microfiber-forming film. The order of combining the materials can be any order: first microfibrillating a microfiber-forming material to form a microfiber material and then contacting or combining the microfiber material with another material in any fashion and entangling the microfibers; or, first combining or contacting a microfiber-forming material with another material, and then microfibrillating to cause both microfiber formation and entanglement. According to either order, microfibers of the microfiber material entangle with the second material, either with microfibers or with other features of a second material.

A microfiber-entangled product can exhibit a combination of properties from each of two or more materials used to make the entangled product. For example, different materials of a microfiber-entangled product can be independently selected to include one or more materials that are hydrophobic; hydrophilic; oleophobic; oleophilic; dielectric; to exhibit a certain mechanical property such as rigidity, flexibility, high or low elasticity, or high or low strength; stain resistance; to give a desired frictional property such as a high or low coefficient of friction; to provide a desired color or color combination; to provide a desired size of fibers, fibrils, or microfibers, or a desired surface area of a microfiber surface; or a combination thereof. As a particular example, one material can be selected to give a hydrophilic surface, while the other portion of the product can have an oleophilic surface.

Different materials of a microfiber-entangled product can be selected to include one or more microfiber-forming layer and one or more layer that is not a microfiber-forming layer, to give a combination of properties from the different layers. The non-microfiber-forming layer can be selected to give a certain physical or chemical property, such as hydrophobicity, hydrophilicity, etc., for its stain or water resistance, or a mechanical property such as rigidity, flexibility, or elasticity. As an example, a second material may be a plastic, a fluoropolymer, a hard yet flexible rubber or soft rubber, an elastomer, and a microfiber-forming polymer, such as polypropylene, or any other material that can be entangled with microfibers. The microfiber-entangled product may exhibit a combination of properties including properties of a waterproof elastomer, and properties of microfiber surfaces, to give an article having combined properties of a flexible or stretchable microfiber-surface-bearing cloth. For microfiber-entangled products prepared from a microfiber material and a second material, where the second material is a non-microfiber material, the non-microfiber forming material may be chosen to provide a property or characteristic that is different from or complementary to a property of a microfiber-material. A complementary property may be one or more of strength in a cross-web direction of the microfiber-material; a fibrous texture, perhaps including fibers or fibrils that are larger in size than microfibers, screens or textured materials, or some other type of reinforcing material.

The ways of incorporating one or more different materials into a microfiber-entangled product will be almost limitless. A single piece of microfiber material or microfiber-forming material may be folded onto itself and microfibrillated to entangle microfibers. This may allow, for example, a continuous cross-lapped microfiber-entangled product having improved strength in multiple directions relative to the film used to produce the cross-lapped microfiber-entangled product. In a different embodiment, microfiber materials or microfiber-forming materials may be woven together and microfibers may be caused to be entangled. In yet a different embodiment, a microfiber material or a microfiber-forming material may be placed in contact with a non-microfiber material or a non-microfiber-forming material, and the microfibers may be caused to entangle the second material.

A microfiber-entangled product may be useful in textiles as textile materials or textile replacement materials. A microfiber material or microfiber-forming material may be twisted, braided, or entwined, etc., optionally with a second material, to form a continuous microfiber-entangled product in the form of a thread, ribbon, yarn, string, rope, twine, or the like. The combination may be processed to cause the materials to be entangled at microfibers, e.g., by microfibrillating the microfiber-forming film, or by other similar processing, to produce a microfiber-entangled material. Such a microfiber material (e.g., a continuous thread, ribbon, or the like) may be processed to produce a thread, ribbon, yarn, string, rope, or twine, etc., and may optionally be further processed, optionally with other materials, using methods that may include sewing, weaving, stitch-bonding, knitting, crocheting, etc. The microfiber material may be incorporated into such a product optionally with or without other non-microfiber materials normally used for these applications. The non-microfiber materials may include threads, ribbons, fabrics, papers, or the like, prepared from natural or synthetic fibers such as wool, cotton, cellulosic fiber, polyolefin, polyester, aromatic polyamide (Kevlar TM), or rayon.

Alternatively, a microfiber-entangled product be useful as any of various multi-surface product constructions such as pads, drapes, cloth-like wipes, microfiber mats, and a large variety of others, prepared from a single material or two or more different types of materials having a variety of combinations of properties.

In a specific embodiment, a microfiber-forming material can be combined with, contacted with, or incorporated into another material, and the microfiber-forming material can be microfibrillated, especially by hydroentanglement, to produce microfibers that become entangled with the other material. In this respect, the invention contemplates microfibrillating a portion of microfiber-forming film in contact with another separate material such that microfibers from the portion of microfiber-forming film become entangled with the separate material (referred to herein as a "second material"). The second material may be a microfiber material, a microfiber-forming material of the same or a different composition as the first microfiber-forming material, or the second material can be any other material that can be entangled with the microfibers.

An aspect of the invention relates to a method of forming a microfiber-entangled product. The method includes contacting a microfiber-forming material with a second material and microfibrillating the microfiber-forming material to form microfibers entangled with the second material.

Another aspect of the invention relates to a method of processing microfiber-forming film. The method includes contacting a first portion of microfiber-forming film with a second portion of microfiber-forming film and microfibrillating the first and second portions to produce microfibers of the first portion entangled with microfibers of the second portion.

Another aspect of the invention relates to a method of forming a microfiber-entangled product. The method includes contacting a microfiber material with a second material and processing the microfiber material to cause microfibers of the microfiber material to entangle the second material.

Still another aspect of the invention relates to a method of forming a microfiber-entangled product. The method includes twisting, braiding, entwining, knitting, or tying, a microfiber-forming material with a second material and microfibrillating the microfiber-forming material to produce microfibers entangled with the second material.

Still another aspect of the invention relates to a method of forming a microfiber-entangled product. The method includes twisting, braiding, entwining, knitting, or tying, a microfiber material with a second material and processing the microfiber material to cause microfibers of the microfiber material to entangle the second material.

Still another aspect of the invention relates to a method of connecting a microfiber-forming film and a second material by entangled microfibers. The method includes contacting the microfiber-forming film with the second material and microfibrillating the microfiber-forming film using a hydroentangling machine to form microfibers of the microfiber-forming film and to entangle the microfibers with the second material.

Yet another aspect of the invention relates to a method of connecting a microfiber material and a second material using entangled microfibers. The method includes contacting the microfiber material with the second material and entangling microfibers from the microfiber material with the second material by hydroentangling.

Yet another aspect of the invention relates to a microfiber-entangled product. The product includes a microfiber material having microfibers entangled with a second material.

DETAILED DESCRIPTION

Microfiber materials and microfiber-forming materials, e.g., microfiber-forming films, useful according to the invention include any materials that include microfibers or that can be processed to form microfibers. Several classes of such materials exist. Examples of some of these materials and their methods of production are described in U.S. Pat. Nos. 6,110,588, 6,331,343 and 6,468,451; the entirety of each of these disclosures is incorporated herein by reference.

In general, a "microfiber-forming material" is any material, especially a film, that is capable of forming microfibers to become a microfiber material. ("Microfiber materials" are materials that have microfibers, e.g., at a surface; a film that includes microfibers is sometimes referred to herein as a "microfiber film.") Microfiber-forming materials are typically made of polymeric materials and have a structure or morphology that includes features which upon mechanical contact will cause a microfiber to be formed from the polymeric film. Properties of a film that facilitate breaking or splitting of the film to form microfibers can include: structural features such as microvoids, spherulites, or other disturbances in the polymer; orientation of the film, especially mono-orientation (uniaxial orientation); multiple layers, especially where an interface at the surfaces of different layers weakens the internal structure of a multi-layer film, and particularly where the layers are very thin; and morphology, such as crystallinity. These properties can be present alone in a film to allow microfibrillation. Alternatively, two or more of the different properties can be present in combination. When combinations of different properties are present, the amount or severity of one or both properties may be reduced relative to the amount or severity of that property that would be necessary to allow microfibrillation if only that single property were present.

Properties that may facilitate microfibrillation can be created in a film during manufacturing of the film to cause the film to be a microfiber-forming film. In general, the described properties and combinations of the properties can be produced in a polymeric film material by selection of one or more of the composition of the film, processing conditions, e.g., during extrusion, and processing conditions after extrusion, possibly including individual steps or combinations of steps such as casting, quenching, annealing, calendering, orienting, solid-state drawing, roll-trusion, and the like.

Polymeric films typically comprise long molecular chains having a backbone of carbon atoms. The theoretical strength of the polymers and the facility with which the surface of a polymer film can be microfibrillated often are not realized due to random orientation and entanglement of the polymer chains. As one method of facilitating microfibrillation, polymer chains can be oriented to be relatively more parallel to one another and partially disentangled. The degree of molecular orientation is generally defined by the draw ratio, which is the ratio of the final length to the original length. This orientation may be effected by a combination of techniques, including the steps of calendering and length orienting.

Microfibrillation of polymeric films or of certain polymeric layers of multi-layer films can be facilitated by orientation, especially with some films, uni-axial orientation. Uni-axial orientation means that the film is lengthened or stretched in one direction relatively more than it is stretched in another direction. By exemplary methods, a film can be stretched in a machine direction while its width is not held, and the film gets longer in length, thinner, and narrower in width. In another exemplary method, the width may be held constant while the length is stretched. In other words, sufficient orientation may be achieved for microfibrillation by inducing a relatively greater amount of orientation in one direction, the machine direction, compared to a lesser degree of orientation in the cross direction.

Crystallinity also affects the ability of a film to form microfibers. A variety of semi-crystalline, crystalline and highly-crystalline can be processed to form microfibers.

Examples of polymeric materials for forming microfiber-forming films can include semi-crystalline melt processed films having a maximized crystallinity induced in the polymeric film layer by an optimal combination of casting and subsequent processing such as calendering, annealing, stretching and recrystallization. For polypropylene, as an example, preferred crystallinity can be above 60%, preferably above 70%, most preferably above 75%. The crystallinity may be measured by differential scanning calorimetry (DSC) and comparison with extrapolated values for 100% crystalline polymers. See, e.g., B. Wunderlich, Thermal Analysis, Academic Press, Boston, Mass., 1990.

The films also may contain spherulites to facilitate microfibrillation. See, e.g., U.S. Pat. No. 6,110,588. Many semicrystalline polymers produce spherulites on crystallization, beginning with nucleation through various stages of crystal growth. Spherulites are birefringent, usually spherical structures that are generally observed by optical techniques such as polarizing optical microscopy.

The presence of "microvoids" can also facilitate the formation of microfibers, e.g., as described U.S. Pat. No. 6,110,588. Microvoids are microscopic voids in the film, or on the surface of the film, which occur when the film is unable to conform to deformation, e.g., upon orientation. See also Roger S. Porter and Li-Hui Wang, Journal of Macromolecular Science-Rev. Macromol. Chem. Phys., C35(1), 63–115 (1995).

Any suitable combination of polymer film composition and processing steps and conditions may be used to impart sufficient microscopic structure, e.g., crystallinity, microvoids, spherulites, multiple layers, orientation, etc., to produce a film that will form microfibers upon microfibrillation. These conditions may include combinations of casting, quenching, annealing, calendering, orienting, solid-state drawing, roll-trusion and the like.

Some specific examples of materials that can be used to prepare a microfiber-forming film are discussed in U.S. Pat. No. 6,110,588. Polymers that may be generally useful include any melt-processable crystalline, semicrystalline or crystallizable polymers.

Useful semicrystalline polymers include high and low density polyethylene, polypropylene, polyoxymethylene, poly(vinylidine fluoride), poly(methyl pentene), poly (ethylene-chlorotrifluoroethylene), poly(vinyl fluoride), poly(ethylene oxide), poly(ethylene terephthalate), poly (butylene terephthalate), nylon 6, nylon 66, polybutene, and thermotropic liquid crystal polymers. Examples of suitable thermotropic liquid crystal polymers include aromatic polyesters that exhibit liquid crystal properties when melted and that can be synthesized from aromatic diols, aromatic carboxylic acids, hydroxycarboxylic acids, and other like monomers. Typical examples include a first type consisting of parahydroxybenzoic acid (PHB), terephthalic acid, and biphenol; a second type consisting of PHB and 2,6-hydroxynaphthoic acid; and a third type consisting of PHB, terephthalic acid, and ethylene glycol. Preferred polymers include polyolefins such as polypropylene and polyethylene which are readily available at low cost and can provide highly desirable properties in microfibrillated articles such as high modulus and high tensile strength.

Preferred semicrystalline polymers can include high density polyethylene, low density polyethylene, polypropylene, polyoxymethylene, poly(vinylidine fluoride), poly(methyl pentene), poly(ethylene-chlorotrifluoroethylene), poly(vinyl fluoride), poly(ethylene oxide), poly(ethylene terephthalate), poly(ethylene naphthalate), poly(buylene terephthalate), nylon 612, nylon 6, nylon 66, polybutene, a thermotropic liquid crystal polymer, a blend of one or more of these polymers with another of these or another polymer, or a copolymer made from any of the listed monomers, and any other listed monomer or a different monomer.

The molecular weight of the polymer can be chosen so that the polymer is melt processable (i.e., extrudable or co-extrudable) under the processing conditions used in extrusion and co-extrusion. For polypropylene and polyethylene, for example, the molecular weight may be from about 5000 to 499,000 and is preferably from about 100,000 to 300,000.

Still referring to the '588 patent, it describes that any suitable combination of processing conditions may be used to impart crystallinity and orientation to a melt-processed film. Starting with a melt-processed, cast film, for example, the film may be calendered, stretched, oriented, cast, quenched, annealed, drawn, roll-truded, etc. Such processing generally serves to increase the degree of crystallinity of the polymer film as well as the size and number of the spherulites.

The '588 patent describes additional details and recites examples of preferred embodiments of materials techniques, and optional processing steps, that may be used to prepare useful microfiber-forming films, e.g., co-extruded multi-layer films. That description, along with the balance of the present disclosure and knowledge available to a skilled artisan, will enable the production co-extruded microfiber-forming films as described herein.

Another class of microfiber-forming materials that can be co-extruded with one or more other microfiber-forming materials into a multi-layer film, includes microfiber-forming materials described in Assignee's U.S. Pat. No. 6,468,451, "FIBRILLATED ARTICLE AND METHOD OF MAKING," the entire disclosure of which is incorporated herein by reference. This patent application describes high melt strength polypropylene foams prepared by extruding a foamable mixture comprising a high melt-strength polypropylene and a blowing agent, and orienting in at least one direction.

The high melt strength polypropylene includes homo- and copolymers containing 50 weight percent or more propylene monomer units, preferably at least 70 weight percent, and has a melt strength in the range of 25 to 60 cN at 190° C. Melt strength may be measured using an extensional rheometer by extruding the polymer through a 2.1 mm diameter capillary having a length of 41.9 mm at 190° C. and at a rate of 0.030 cc/sec; the strand is then stretched at a constant rate while measuring the force. Preferably the melt strength of the polypropylene is in the range of 30 to 55 cN, as described in WO 99/61520, the entirety of that disclosure being incorporated by reference.

The foamable polypropylene may consist of propylene homopolymers or may comprise a copolymer having 50 weight percent or more propylene monomer content. Further, the foamable polypropylene may comprise a mixture or blend of propylene homopolymers or copolymers with a homo- or copolymer other than propylene homo- or copolymers.

A variety of blowing agents may be used, including physical blowing agents and chemical blowing agents. The amount of blowing agent incorporated into a foamable polymer mixture can be chosen to yield a foam having a void content in excess of 10%, and even in excess of 20%, as measured by density reduction; i.e., 1−(the ratio of the density of the foam to that of the neat polymer)×100. Generally, these greater foam void contents can enhance microfibrillation and can produce a greater yield of a microfibrillated surface.

To facilitate microfiber-formation from the film, the film (i.e., its polymer chains) may be oriented along at least one major axis. The stretching conditions can be suitable to increase the crystallinity of the polymer and the void volume of the foam. It has been found that an oriented foam is readily microfibrillated even with a relatively low void content when compared to oriented, unfoamed films, and is readily fibrillated at a lower total draw ratio compared to unfoamed film. In other words, the foam films need not be as highly oriented as non-foam films to achieve microfibrillation.

The foam may be oriented by stretching at a temperature above the alpha transition temperature and below the melting temperature of the polymer. Foams may be stretched in one or both directions to a preferred total draw ratio in the range from 3 to 50. Greater orientation is achievable using foams of small cell size; foams having cell size of greater than 100 micrometers are not readily oriented more than 20 times, while foams having a cell size of 50 micrometers or less may be stretched up to 50 times total draw ratio.

Methods for producing polymeric films, including single layer polymeric films, multi-layer polymeric films, and microlayer films, are well known in the arts of polymeric materials and film processing, and materials such as those just described can be incorporated into those methods to produce microfiber-forming films that include those materials. Examples of useful techniques include extrusion, co-extrusion, lamination, and other known methods of processing films. Useful equipment for producing the films will also be apparent to those of ordinary skill in the art, including extruders, multi-cavity die extruders, laminators, among various others known in the arts of films and film processing, some of them being mentioned herein.

Also well known in the art of polymeric films are subsequent processing techniques for films such as casting, quenching, annealing, calendering, orienting, solid-state drawing, roll-trusion and the like. Using these techniques, suitable equipment, and the present disclosure, a skilled artisan will be able to understand how to prepare microfiber-forming films and microfiber-entangled products according to the invention.

Another type of microfiber-forming film that can be used according to the invention to produce microfiber-entangled products includes those multi-layer films sometimes referred to as "microlayer films." Microlayer films are known in the arts of polymeric films, and are well known for their optical properties. Examples of microlayer film constructions and methods for preparing microlayer films (and some explanation of their uses and principles of their operation) are described, for example, in the following United States patents, the entirety of each of which is incorporated herein by reference; U.S. Pat. Nos. 5,269,995, 6,124,971, and 6,101,032. See also Assignee's copending United States patent application U.S. Ser. No. 09/858,253 entitled "Fibrous Films and Articles from Microlayer Substrates," filed on even date herewith and the entirety of which is incorporated herein by reference.

Constructions of microlayer films are generally understood, and are known for the specialty optic properties. Microlayer films useful in the present invention, while being similar in construction and methods of preparation, are prepared with the idea of forming microfibers from the film, as opposed to providing films with select optical properties.

Microlayer films can be produced from a great variety of polymeric materials co-extruded to form a stack of multiple (preferably a very large number) layers of one or different polymers, copolymers, or mixtures of polymers, having very small, preferably extremely small thicknesses.

The thickness of the total film and the individual layers of a microlayer film can be any thicknesses that will allow microfibrillation. Each of these thickness values may have practical limitations based on processing considerations, such as the total maximum number of layers that can be cast using a co-extrusion process, the minimum thickness of such layers, and the total thickness of a coextruded film that can be either cast or further processed, e.g., calendered.

A microlayer film can include tens, hundreds, thousands, or tens of thousands of layers of the same, similar, or any number of different polymeric compositions, which may be a single polymer, a copolymer, or a mixture of two or more polymers or copolymers. Reasons for choosing a polymer or copolymer as part of a stack can depend on various factors relating especially to the desired properties of different layers of the stack (e.g., hydrophobicity, oleophobicity, etc.); how those properties relate to other layers of a stack; and the ability of different types of materials to form microfibers; among other factors. For instance, microlayers of two or many more polymeric materials can be included in a single microlayer stack to obtain a microlayer film that can be microfibrillated to produce microfibers with any number of different polymers and properties on a single microfiber surface.

The microlayer film can contain as many materials as there are layers in the stack. For ease of manufacture, preferred stacks may contain only a few different materials, or only one or two.

Examples of useful polymer materials for layers of a microfiber-forming microlayer film can include such polymeric materials as polyethylene naphthalate (PEN); polyesters such as polyethylene terephthalate (PET); amorphous copolyesters, copolymers of PEN such as 90/10 Co-PEN; PETG glassy PET); poly methyl(meth)acrylate and copolymers thereof; polypropylene; polystyrene, atactic polystyrene, polyethylene, fully saturated ethylene/propylene rubber in a polypropylene matrix, metallocene poly(alpha-olefin) ethylene-propylene, ethylene vinyl acetate in polypropylene, maleate grafted polypropylene in polypropylene, and the like.

In certain microfiber-entangled product constructions, an oriented and microfibrillated microlayer film may advantageously contain fibers made up of different polymeric materials. This can mean that different, individual, microfibers of a microfiber material prepared from a microlayer film may be made of different materials, e.g., originating from different layers of the microlayer film. This may also mean that a single microfiber may be made of more than one material, from a single microlayer made of a blend or mixture of polymeric materials. Preferably, the materials that make up microfibers can originate from more than one of the different layers of the microlayer film, with each layer having the same composition or a different composition.

Certain microlayer films can be oriented, especially uniaxially oriented, to cause one or more of the layers to become a microfiber-forming layer.

Microlayer films can be produced using co-extrusion techniques and equipment generally known to the skilled artisan. Generally, according to co-extrusion methods, multiple streams of one or a number of different melt processable materials are divided to flow through a modular feedblock, which may be further divided into substreams and re-combined into a composite stream that passes through an extrusion die to form a multi-layer film, in which each very thin layer is generally parallel to the major surfaces of adjacent layers.

The number of layers in the film can be selected to achieve desired microfibrillation properties, typically using a minimum number of layers for reasons of film thickness, flexibility and economy. While films having more layers can also be useful, e.g., up to 40,000 layers or more, useful films can typically have fewer than 10,000 layers, more preferably fewer than 5,000, and even more preferably fewer than 2,000 or 1,000 layers.

Typical total thicknesses of cast films, after extrusion but prior to any post-extrusion processing such as lengthening or calendering, can be in the range from about 5 mils (127 μm) to about 400 mils (10,160 μm), e.g., from about 10 mils (254 μm) to about 400 mils (10,160 μm), e.g., 10 to 100 mils (254 μm to 2540 μm), and with the range from about 30 mils (762 μm) to about 65 mils (1651 μm) sometimes being preferred. The thickness of typical layers of a microlayer film, as extruded and prior to subsequent processing such as calendering and stretching, can be any thickness, generally from about 2 microns to about 10,000 microns, with typical thicknesses being approximately in the range from about 2 microns to about 100 microns.

The ability to achieve microfibrillation of a microlayer film can be influenced by the composition of the layers, the number of layers and thickness of each layer, and processing conditions used to prepare the film. In the case of organic polymers which can be oriented by stretching, the films are generally prepared by extruding and orienting by stretching at a selected temperature, optionally followed by heat-setting at a selected temperature. Alternatively, the extrusion and orientation steps may be performed simultaneously. It has been found that microfibrillation of the microlayer films can be achieved by stretching a film substantially in one direction (uniaxial orientation or mono-axial). A uni-axial orientation of 3:1 or more is typically useful.

The invention contemplates microfiber-entangled products that include a microfiber material or a microfiber-forming material physically commingled, e.g., in contact with, one or more of another microfiber material, another microfiber-forming material, or with another similar or dissimilar, e.g., non-microfiber-forming material. The combination of materials can be chosen to exhibit a combination of properties based on the properties of the different individual materials.

Materials of the microfiber-entangled product (the microfiber materials, microfiber-forming materials, or non-microfiber or non-microfiber-forming materials) can be contacted and/or combined at any time, either before or after a microfiber-forming material is microfibrillated. Entangled microfibers can be achieved by combining or commingling a microfiber material (previously microfibrillated to form microfibers) with a second material (microfiber material, microfiber-forming material, or non-microfiber-forming or non-microfiber material), and then causing the microfibers to become entangled with the second material. Or, a microfiber-forming material can be combined or contacted with any such second material followed by microfibrillation of the microfiber-forming material to produce microfibers and also to cause the microfibers to entangle with the second material.

The invention relates to microfiber-entangled products that include microfibers of a microfiber material entangled with a second material. The second material can be a microfiber material (any material that includes microfibers) or a different material that has a feature, shape, surface or texture with which microfibers from the microfiber material can become entangled.

The invention can be useful to produce a great variety of different product forms, a few of which are mentioned as follows.

One type of microfiber-entangled product is a class of microfiber-entangled products where microfibers from a microfiber material are entangled with other microfibers, which may be from the same piece of microfiber material or from a separate piece of microfiber material. In this embodiment, the second material is itself a microfiber material, and the microfibers from each of the two microfiber materials (whether they are the same piece or two different pieces) become entangled to produce a microfiber-entangled product. The microfiber material of the "second material" can be the same as or different from the first microfiber material. In other words, a microfiber-entangled product can be prepared from two microfiber materials that might be different microfiber materials, similar, or identical.

To produce such a microfiber-entangled product, a portion of microfiber-forming material can be contacted with a different portion of microfiber-forming material. The different portions of microfiber-forming materials can be microfibrillated to produce microfibers on each portion, and the microfibers from the different portions become entangled with each other to produce a microfiber-entangled product.

The different portions of microfiber-forming materials can be any portions of a microfiber-forming material, e.g., a microfiber-forming film, including edge portions or surface portions. As discussed elsewhere, and as illustrated, e.g., in FIGS. 1 through 3 and others, different portions of microfiber-forming materials that become entangled through their respective microfibers can be portions of a single piece of a microfiber-forming material (see, e.g., FIG. 1), or can be portions of separate pieces of microfiber forming material (see, e.g., FIG. 3).

A useful aspect of the invention includes the ability to connect different portions of microfiber materials together using entangled microfibers. An edge portion of a microfiber material can be connected to, e.g., become physically connected, joined, linked, mended, or bonded with an edge or surface of another microfiber material, using entangled microfibers to form a "seam." See, e.g., FIGS. 1, 2, 3, 22, 23, and 24.

Surprisingly, the strength of such a seam, based on entangled microfibers, can be substantially as strong as the strength of bulk portions of microfiber materials, even without using additional bonding materials or bonding techniques such as stitch-bonding or adhesives. Also, in preferred embodiments of microfiber-entangled products, a seam that connects portions of microfiber materials, especially a seam that connects two edges, can blend in very well with the bulk of the microfiber-entangled product. Such a seam can be very difficult to detect visually, with a naked eye, by microscopy (i.e. SEM), or by tensile testing (e.g., the seam may be at least 75% or 90% as strong as the bulk microfiber film).

Figure 2:
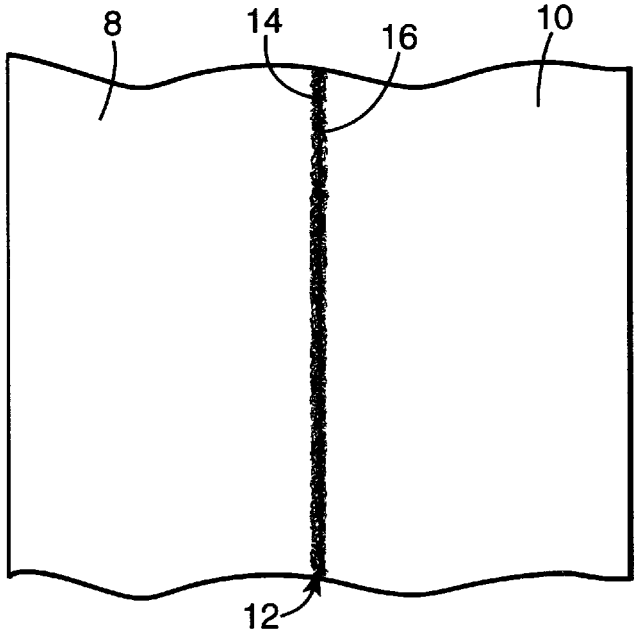
FIG. 2 generally illustrates a microfiber-entangled seam.

FIG. 2 illustrates a simplified explanation of products and methods of the invention relating to edges of microfiber materials joined with entangled microfibers. FIG. 2 shows segments of microfiber material 8 and microfiber material 10 comprising edge portions 14 and 16, respectively. The figure also collectively identifies microfibers 12, some originating from the segment of microfiber material 8 and some originating from the segment of microfiber material 10. According to the invention, the microfibers are entangled to mechanically connect or link edges 14 and 16, forming a seam. See FIGS. 21, 22, and 23.

Surfaces of microfiber materials can also be connected or joined with entangled microfibers. Thus, a microfiber-entangled product can be formed with microfibers of surfaces of microfiber materials being entangled to connect the two surfaces. Such a microfiber-entangled product may be prepared, for example, by contacting two surfaces of microfiber-forming materials and microfibrillating the surfaces to form microfibers at each surface that are entangled with each other.

The microfiber materials can be the same or different microfiber materials. For instance, a microfiber-entangled product may be formed by combining and entangling two or more different materials, e.g., two or more different microfiber materials, to produce a product having a combination of properties derived from the different materials.

Microfibrillation and entanglement can be accomplished separately, using different steps and different processes or equipment, or can be accomplished at approximately the same time or simultaneously. To produce a microfiber-entangled product that has entangled microfiber surfaces, a microfibrillation or separate entanglement step may microfibrillate fully through at least a portion of a microfiber-forming film, and at least partially into another microfiber-forming material in contact with the first portion, to produce microfibers at each surface that are entangled. The microfiber-forming materials can be microfibrillated through the full thickness of one microfiber-forming film to allow fibrillation of at least a surface of a second microfiber-forming film that is in contact with the first. Also optionally, a process can microfibrillate through two or more microfiber-forming films, either by microfibrillating from one side all the way through one film to the surface and through the second film, or by microfibrillating from both sides of contacted microfiber-forming films toward the middle of the films, to produce two microfiber surfaces with entangled microfibers. In general, the degree of microfibrillation may be sufficient to produce microfibers from each of the films, which become entangled.

Figure 4:
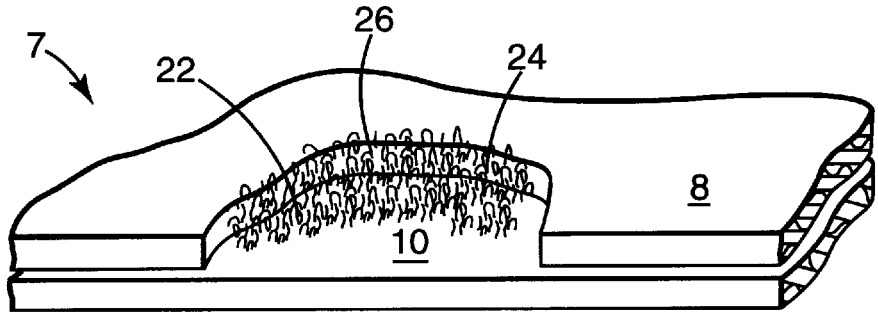
FIG. 4 generally illustrates a microfiber-entangled surface.

FIG. 4 generally illustrates microfiber-entangled surfaces of microfiber materials. Referring to FIG. 4, microfiber-entangled product 7 is shown, comprising microfiber material 8 and microfiber material 10 arranged with surfaces that contact each other, together comprising a microfiber-entangled surface. Looking at the area of the cut-out of upper layer 8, microfiber material 10 has a microfiber surface 22 in contact with microfiber surface 24 of microfiber material 8. In this area, microfiber material 8 has been microfibrillated to produce microfibers from microfiber material 8; moreover, microfiber material 8 has been microfibrillated entirely through, so that microfibers have also been produced on microfiber surface 24 of microfiber material 10. Consequently, a microfiber surface 26 is formed at the surface of microfiber-entangled product 7, wherein microfiber surface 26 includes microfibers from both of microfiber materials 8 and 10. Optionally, microfiber material 10 may also be microfibrillated fully through, to produce a microfiber surface (not shown) at the other (bottom) surface of microfiber material 10, comprising microfibers of microfiber material 10 and optionally further comprising microfibers from microfiber material 8.

Figure 5:
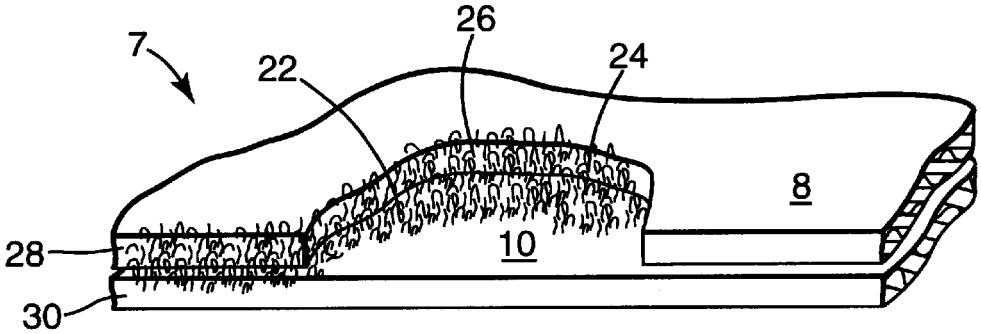
FIG. 5 generally illustrates a microfiber-entangled surface and an optional microfiber-entangled edge.

FIG. 5 illustrates a related embodiment of a microfiber-entangled product comprising a microfiber-entangled surface 26 (as illustrated in FIG. 4) and additionally comprising a microfiber-entangled edge 29. As with FIG. 4, the microfiber-entangled product 7*a* includes a microfiber-entangled surface between microfiber materials 8 and 10. Additionally, FIG. 5 shows microfiber-entangled product 7*a* having edges 28 and 30 of microfiber materials 8 and 10, respectively. These edges include microfibers entangled with each other to connect the microfiber materials at the edges, i.e., at a microfiber-entangled edge 29. The overall microfiber-entangled product could include substantially fully microfibrillated edges and surfaces, optionally substantially through the microfiber materials across the entire surface areas and at all edges of both of microfiber materials 8 and 10.

Figure 6:
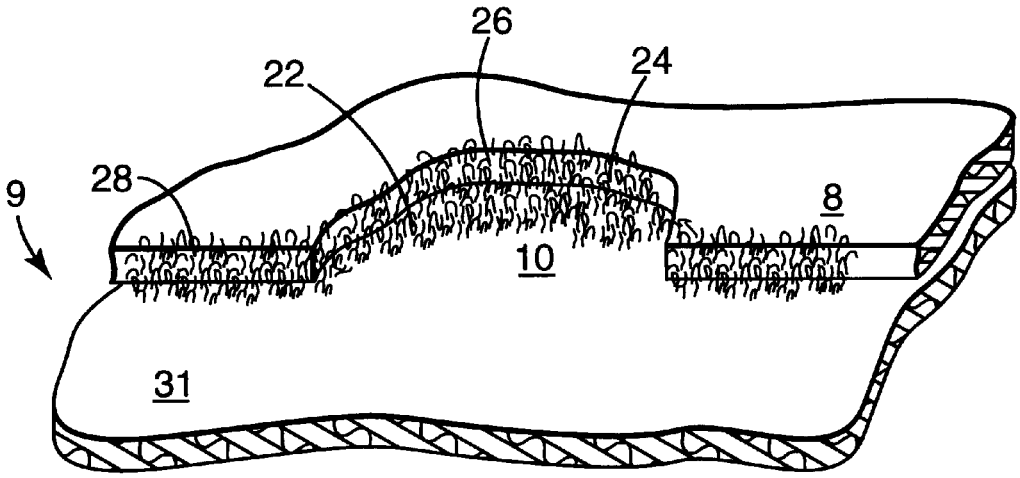
FIG. 6 generally illustrates a microfiber-entangled surface and an optional microfiber-entangled interface between an edge and a surface.

In a variation of the microfiber-entangled products of FIGS. 4 and 5, a microfiber entangled article could include a microfiber-entangled surface (as shown in FIGS. 4 and 5) and instead of a microfiber-entangled edge as shown in FIG. 5, could include a microfiber-entangled interface between an edge portion of a microfiber material and a surface portion of a microfiber material. FIG. 6 illustrates a microfiber-entangled product 9 comprising a microfiber-entangled surface 26 and additionally comprising a microfiber-entangled interface between a surface 31 and an edge 28. As with FIG. 4, microfiber-entangled product 9 includes a microfiber-entangled surface between microfiber materials 8 and 10. Additionally, FIG. 6 shows microfiber-entangled product 9 having edge 28 and surface 31 of microfiber materials 8 and 10, respectively. Edge 28 and surface 31 include microfibers entangled with each other to connect the microfiber materials along the interface between the edge 28 and surface 31. The overall microfiber-entangled product could include substantially fully microfibrillated edges and surfaces, optionally substantially through the microfiber materials across the entire surface areas and at all edges of both of microfiber materials 8 and 10. Edges and surfaces such as these may be present, for example, in embodiments of the invention that include cross-lapping or weaving, such as the articles of FIGS. 7 and 8.

Figure 3:
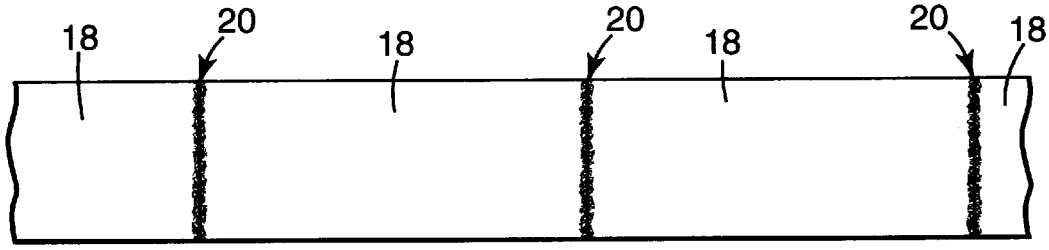
FIG. 3 illustrates an example of a continuous web prepared according to the invention.

Any of the above microfiber-entangled interfaces of FIG. 3, 4, or 5, can be produced with a single piece of microfiber material folded to contact different portions of the material—i.e., different edge portions or surface portions—or with two or more pieces of microfiber material that are configured to contact different combinations of edge portions and surface portions of the different microfiber materials.

Following are a few examples of how a single piece of microfiber material can be folded or otherwise configured to produce exemplary embodiments of microfiber-entangled products.

In general, any type of microfiber-entangled interfaces could be constructed of a single piece of microfiber material that is looped, folded, or otherwise configured to cause edge-to-edge contact, surface-to-surface contact, or surface-to-edge contact, with microfibers from different surfaces and edges being entangled. A microfiber-forming film may be configured in any manner to contact different portions of the microfiber material, i.e., different combinations of surfaces and edges, and then the microfiber-forming film can be microfibrillated to produce entangled microfibers. Or, a microfiber material may be configured to contact different combinations of surfaces and edges, and then the microfiber material may be processed, e.g., hydroentangled, to entangle the microfibers.

In a particular embodiment of the invention, edges of a single piece of microfiber material can be connected with entangled microfibers. As will be understood, connecting different edges of a single piece of microfiber material can result in a variety of product configurations. Such microfiber-entangled products can be produced, e.g., by contacting edge portions of a single microfiber-forming film and microfibrillating the edge portions to form microfibers from each edge portion, so that microfibers from the different edge portions become entangled.

An example of such a microfiber-entangled product is a single piece of microfiber material connected along edges of the microfiber material by entangled microfibers. This is an example where what is referred to as the "second material" is a microfiber material, and in fact the "second material" in this instance is actually just a different edge (alternatively area or surface) of the same microfiber material.

FIG. 1 shows microfiber-entangled product 2 that is a single piece of microfiber material 6, looped so that microfibers of different edges come into contact at a seam 4.

As will be understood from the figure and this description, a microfiber-forming film could be of a different shape, or could be curved or folded in any other arrangement to connect edges to produce a variety of other types of three-dimensional products, such as longer tubes or cylinders, cones, or any other desired shape or two or three-dimensional form that can be produced by starting with a flat or curved microfiber-forming film.

As opposed to the simple looped configuration of FIG. 1, a single piece of microfiber material can be formed into various other microfiber-entangled products, using relatively more complex patterns of folds.

One example is a cross-lapped microfiber-entangled product. As background, microfiber materials may have a desired strength in one direction, e.g., a "machine" direction, but less strength in a "cross" direction. Folding or lapping a microfiber material can be done so that areas of microfiber material having the direction of strength (machine direction) directed in one direction, contacting areas of the same microfiber material having a direction of strength in at least a slightly different direction. Stated differently, microfiber-entangled surfaces can be folded to contact portions of a material to exhibit strength in different directions, preferably in substantially perpendicular directions, to give a final microfiber-entangled product construction with good strength in all directions.

As an example, a single piece of continuous microfiber-entangled material can comprise a folded, e.g., cross-lapped microfiber material having microfibers entangled at one or more of its edge and surface interfaces.

Figure 12:
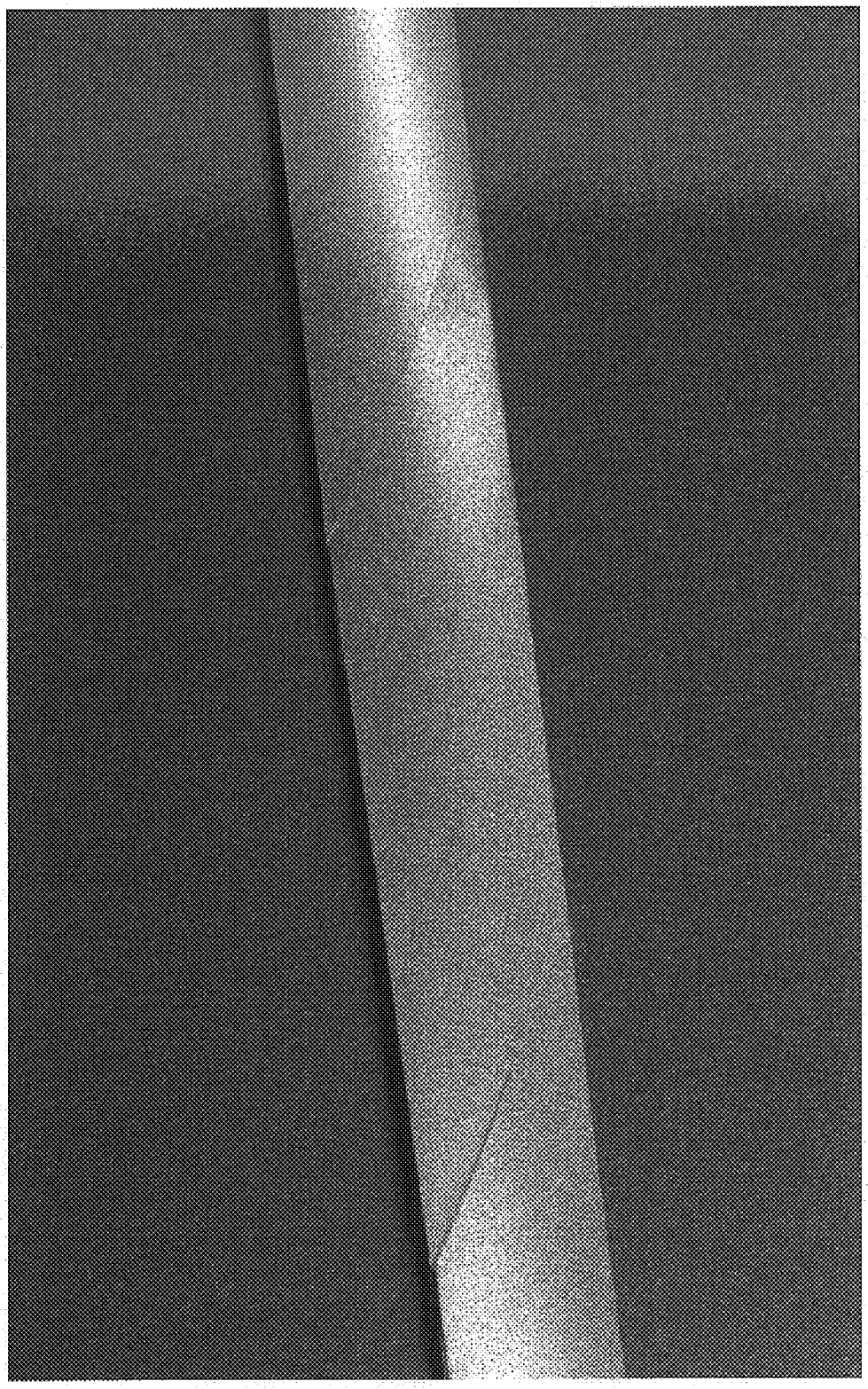
FIG. 12 is a photograph of cross-lapped film.

A cross-lapped microfiber-entangled product can be prepared by folding a single, preferably continuous, microfiber-forming film so a least one edge portion of the film contacts at least one surface portion of the same film. Typically, continuous edge portions will continuously contact surface portions. Preferably, surface portions will contact other surface portions in a manner that will provide a microfiber-entangled product with improved strength; e.g., in a perpendicular manner, so that cross-direction microfiber-forming film overlaps machine direction microfiber-forming film. The term "cross-lapping" will be understood by those of skill. One way of describing cross-lapping is as the process of repeatedly folding or lapping a continuous film over itself to produce multiple interfaces between film surface portions and film edge portions. The method can be used to fold a single continuous microfiber-forming film of one thickness and width into a single wider and thicker length of film. E.g., see FIG. 7 and FIG. 12, which show a single continuous film of microfiber-forming film 8, of width 5, being repeatedly lapped over itself into a folded spiral to form a cross-lapped microfiber-entangled product 13 of width 11 (microfibers are not specifically shown in FIG. 7). Edges 15 of microfiber-forming film 8 contact surfaces of the film in a regular, repeating fashion. A different embodiment of a crosslapped film, not shown in either figure, could be prepared by folding without producing a spiral, i.e., making each fold in the same direction such that folds do not loop to form a spiral. In preferred embodiments of either crosslapped article, the folds can be made to provide a uniform thickness of the folded material that is twice the thickness of the film.

Figure 7:
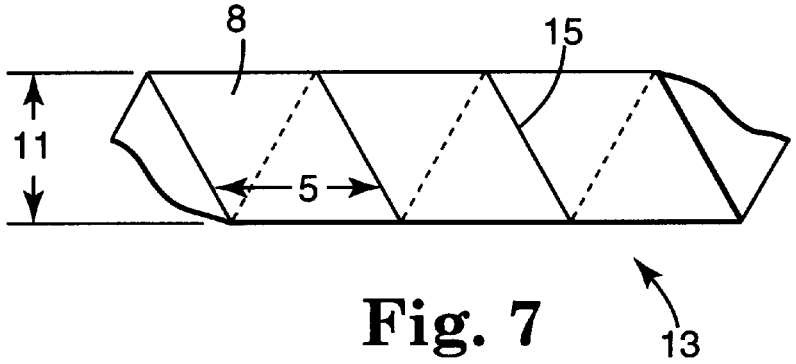
FIG. 7 illustrates an example of a cross-lapped microfiber-entangled product.
Figure 13:
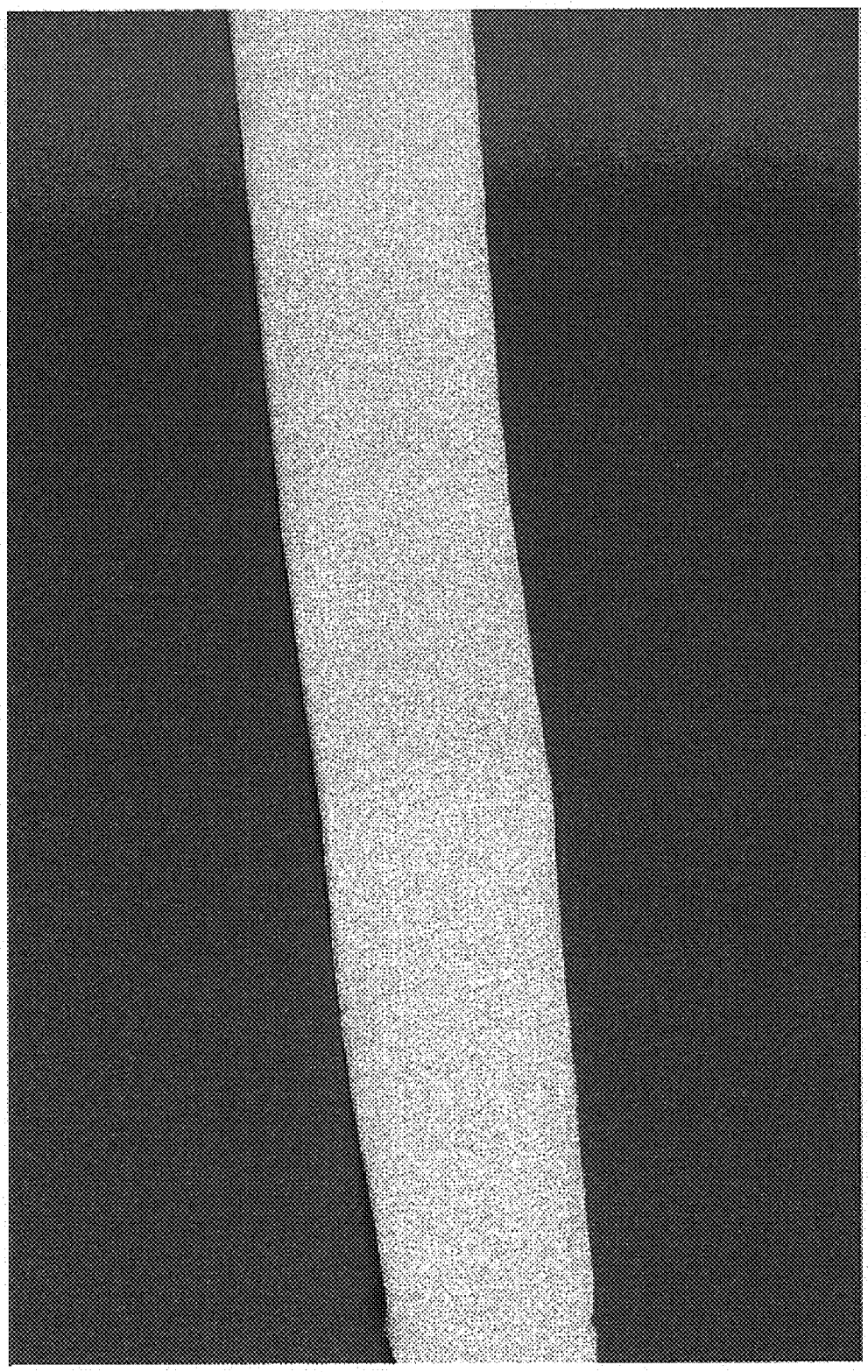
FIG. 13 is a photograph of cross-lapped film after hydroentangling.

A microfiber film that is cross-lapped as in FIG. 7 can be processed to cause microfibers from different portions of the microfiber film to become entangled, e.g., similar to the microfiber interfaces illustrated in FIG. 6. Similarly, a cross-lapped microfiber-forming film folded as in FIG. 7 or 12 can be microfibrillated at one or more of the interfaces, i.e., at one or more of the edge-surface and surface-surface interfaces, to first form microfibers and to entangle the microfibers, forming a microfiber interface as shown in FIG. 6. Also after production and/or entanglement of the microfibers, e.g., by hydroentanglement, the interface between continuous edge 15 and the surface that contacts continuous edge 15 will be a seam that is difficult to visually detect. See FIG. 13, which shows the microentangled article produced upon microfibrillating crosslapped the film of FIG. 12.

Following are examples of how two or more types or different pieces of microfiber material can be used together, e.g., woven, twisted, wound, folded, entwined, or braided together, etc., or otherwise incorporated into or configured with each other to form a variety of microfiber-entangled products.

In general, any type of microfiber-entangled interfaces could be constructed of two or more pieces of microfiber materials situated to cause edge-to-edge contact, surface-to-surface contact, surface-to-edge contact, or any other contact that allows entanglement of microfibers from different portions of microfiber materials.

The microfiber materials can have the same, similar, or entirely different compositions. To produce such a microfiber-entangled product, two or more microfiber-materials or microfiber-forming films may be configured in any manner to contact different portions of the microfiber material or microfiber-forming films, i.e., different combinations of surfaces and edges, and then microfibers can be entangled or microfibers can be formed and entangled.

This aspect of the invention can be useful to produce a variety of useful microfiber-entangled products.

For example, two or optionally many more than two pieces of the same or different microfiber film or microfiber-forming film can be connected along edges to produce a continuous, extended microfiber film with microfiber-entangled edges. In other words, a microfiber-entangled product may be a continuous web of material of relatively long or extremely long length or width, or both, connected by microfiber-entangled seams. Advantageously, the seams can be very difficult to visually detect, and can exhibit a strength that is substantially similar to the strength of a bulk of a microfiber material. A method of producing such a microfiber-entangled product can include first aligning or abutting edge portions of separate microfiber-forming films, and microfibrillating the edge portions to form microfibers at each edge so that microfibers originating from each edge portion become entangled. Alternatively, edges of microfiber films can be aligned or abutted and then processed to entangle microfibers from the different edges.

FIG. 3 illustrates a web of connected microfiber materials. FIG. 3 shows a series of microfiber material films 18 of relatively greater length versus width. The edges of each web are connected by microfiber-entangled seams 20. With this method, a theoretically endless series of webs 18 could be joined to produce a theoretically endless length of a continuous, virtually seamless, web. Parallel continuous seamless webs could be joined along their length-wise edges to produce films of multiplied widths.

A different example of such a microfiber-entangled product is a woven microfiber-entangled product. As with folded or cross-lapped microfiber-entangled products, woven microfiber-entangled products can take advantage of the directional strength of a microfiber material, i.e., the relative difference in strength of a microfiber material in a "machine" direction versus a "cross" direction. Weaving separate pieces of microfiber material so that areas of microfiber material having the direction of strength (machine direction) directed in one direction contacting areas of the microfiber material having a direction of strength in at least a slightly different direction, preferably in perpendicular directions, can give a final microfiber-entangled product construction with strength in all directions.

Figure 8:
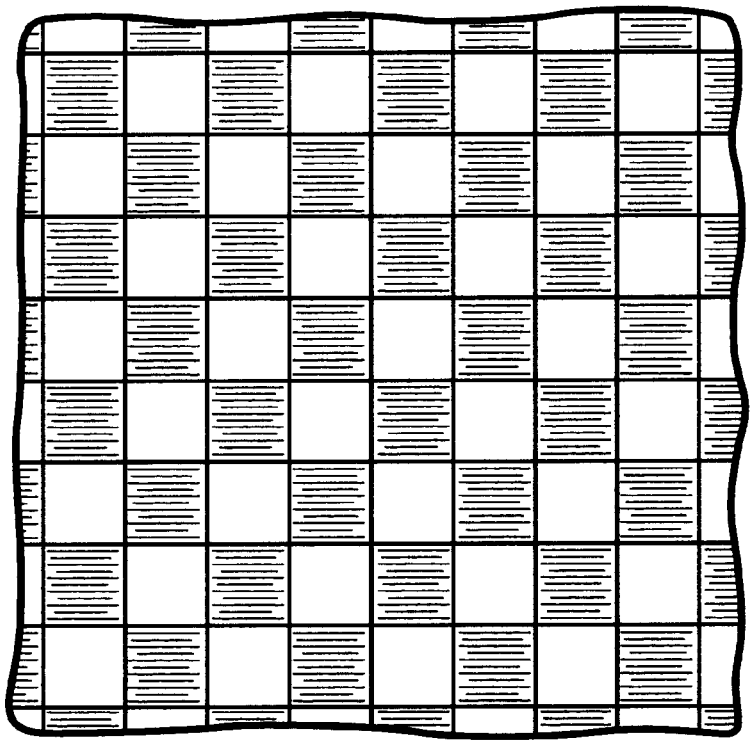
FIG. 8 illustrates an example of a woven microfiber-entangled product or a precursor thereof.
Figure 9:
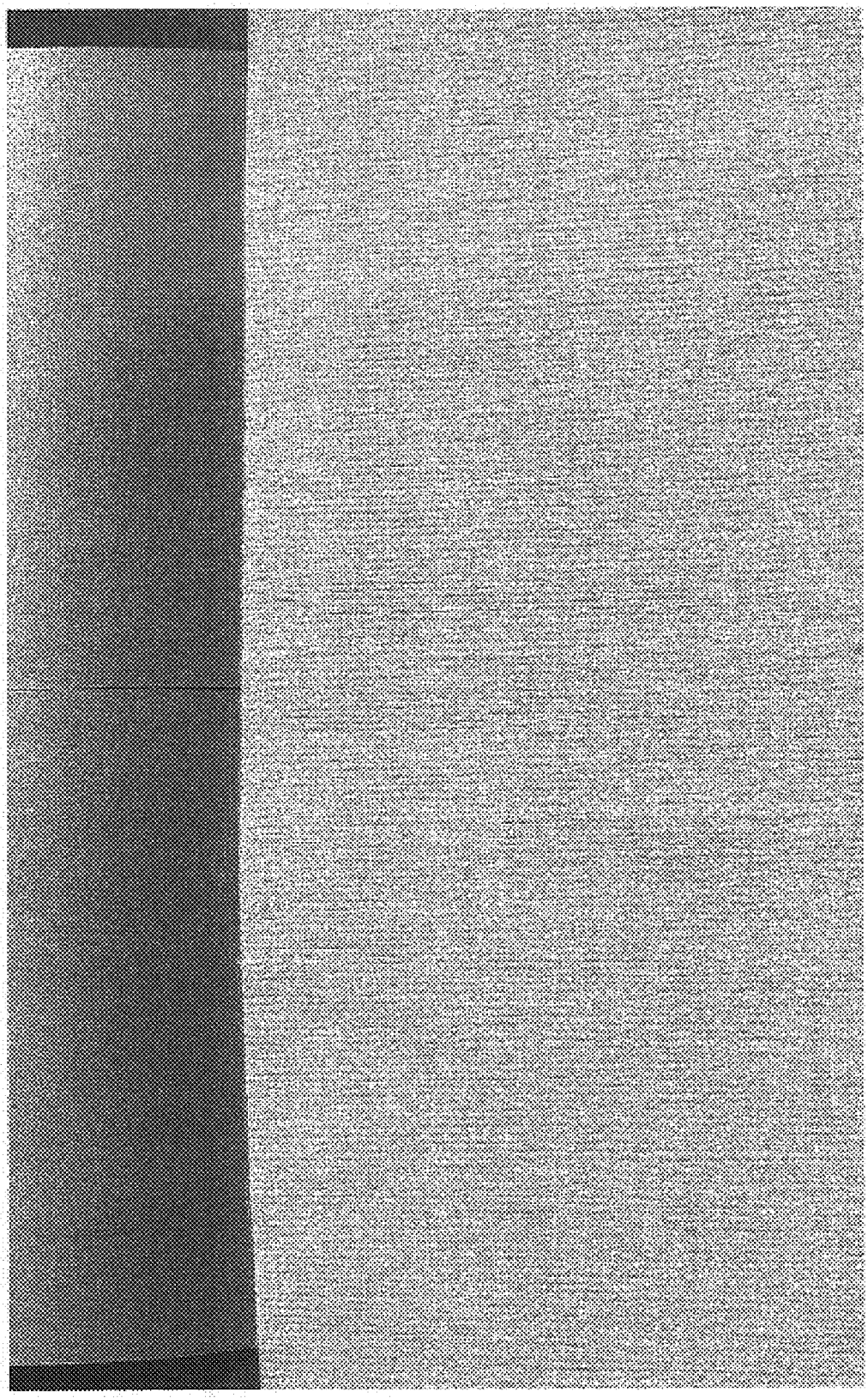
FIG. 9 is a photograph of films before and after microfiber-entangled seam formation.
Figure 10:
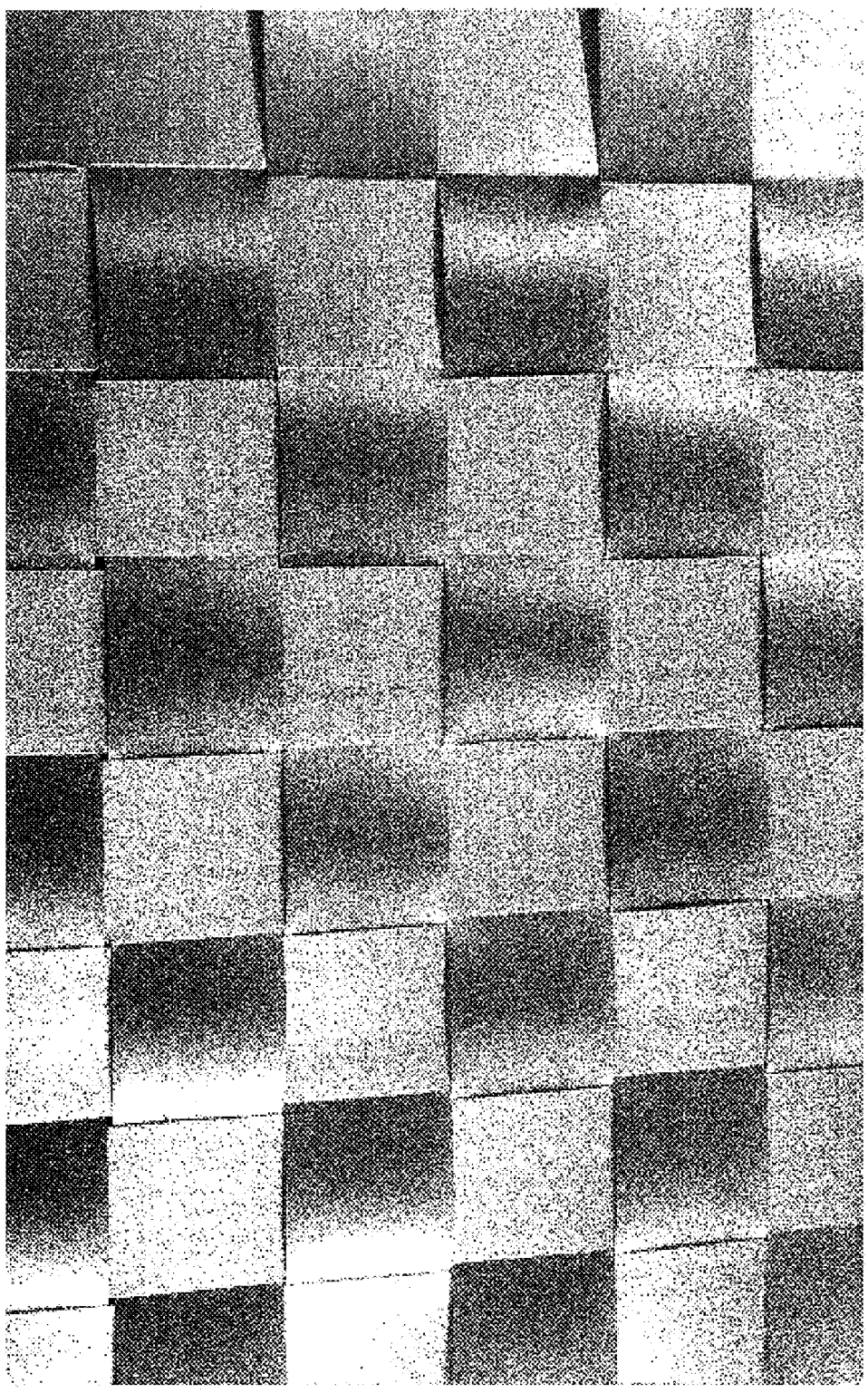
FIG. 10 is a photograph of woven films before hydroentangling.
Figure 11:
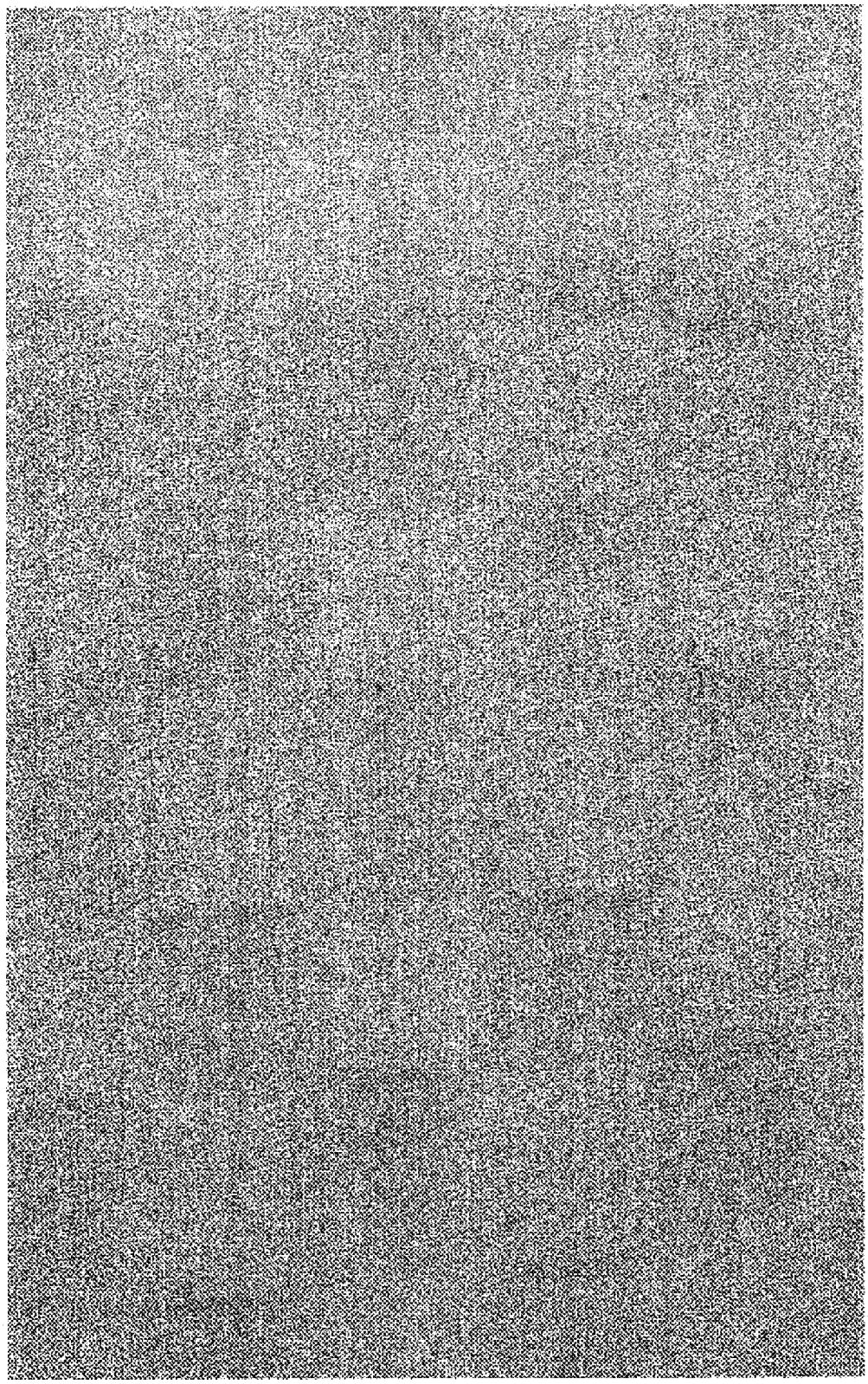
FIG. 11 is a photograph of woven films after hydroentangling.

FIG. 8 illustrates a woven microfiber-entangled product having strips of microfiber material woven together in a crossing pattern. (See also FIG. 10.) Such patterns and methods of forming microfiber materials into the patterns are well known and will be apparent to the skilled artisan. Microfibers originating from edge portions of the woven microfiber materials can be entangled with microfibers originating from surface portions. Optionally, microfibers originating from surface portions may also be entangled with microfibers originating from other surface portions. Overall, microfiber-entangled interfaces may look like the microfiber entangled edge-surface interface of FIG. 6. FIG. 10 shows a woven construction before hydroentanglement, and FIG. 11 shows the same woven construction after hydroentanglement. The photographs show that the hydroentangled woven article can have seams that blend in with the bulk of the article and are therefore difficult to detect, and that the hydroentangled product can exhibit a generally uniform appearance. As stated elsewhere, the crossing pattern provides cross-directional strength to the entire product.

In addition to folding, lapping, cross-lapping, weaving, etc., microfiber-entangled products can be formed into any other of a large variety of configurations, including those available or useful in the fabric, textile, or clothing arts. Thus, microfiber-entangled product constructions may include products that are useful in textile-replacement applications. Such products can be prepared by one or combinations of twisting, braiding, or entwining microfiber materials or microfiber-forming materials and causing entanglement. These types of processing steps can be used to form a microfiber material or a microfiber-forming material having microfibers that are entangled with a second material that may be or may not be a microfiber material, into product constructions that would be conventionally formed by such methods. Examples of useful product constructions may include rope, twine, string, yarn, other extended fibrous materials etc., and eventually, products made from these materials, such as woven or non-woven fabrics, knitted or crocheted materials or items.

As an example of how this might be accomplished, a microfiber-forming film or a (previously microfibrillated)

microfiber film may be slit into a continuous ribbon, preferably of a relatively narrow width. The ribbon may be twisted, braided, knitted, tied, or entwined, etc., optionally in combination with a second material, to form an optionally continuous microfiber material in the form of a thread, ribbon, yarn, string, rope, twine, or the like. The combination may be processed to cause the materials to be entangled at microfibers, e.g., by microfibrillating the microfiber-forming film, or by other similar processing, to produce a microfiber-entangled product, optionally one that is also continuous.

Such a resultant continuous microfiber material (e.g., thread, ribbon, or the like), may be processed using conventional methods, in conventional applications that typically incorporate threads, ribbons, yarns, strings, rope, or twine, etc. These methods may include sewing, weaving, stitch-bonding, knitting, crocheting, filament winding, etc. The continuous microfiber material may be incorporated into such a product optionally with or without other non-microfiber materials normally used for these applications. The non-microfiber materials may include threads, ribbons, fabrics, yarns, rovings, or the like prepared from natural or synthetic materials such as wool, cotton, fiber glass, polyester, rayon, polyolefin, polyamide, and aramid.

As with other product configurations specifically discussed above, microfiber materials of microfiber-entangled products useful in textile replacement applications may be microfibrillated at any time that allows for entanglement of the microfibers. A microfiber-forming film may microfibrillated at any time, before or after being combined with or incorporated into a second material, to produce a microfiber material. According to some preferred methods, a microfiber-forming film can be placed into contact with a second material of a textile replacement article, and the combined material can be passed through a microfibrillation process so that microfibrillation and entanglement occur substantially simultaneously.

The above discussion includes language specifically describing microfiber-entangled products prepared from one or more pieces of microfiber materials or microfiber-forming materials, including single pieces folded into contact with themselves, or different microfiber materials in combination with other microfiber materials.

Advantageously, different microfiber materials can be selected based on their different individual properties, and used together in combination to produce a microfiber-entangled product having a combination of desired properties. For example, different microfiber materials can be independently selected and include microfibers or microfiber surfaces that are one or more of hydrophobic; hydrophilic; oleophobic; oleophilic; dielectric; to exhibit a certain mechanical property such as rigidity, flexibility, high or low elasticity, or high or low strength; stain resistant; to give a desired frictional property such as a high coefficient of friction; to provide a desired color or color combination; to provide a desired size of fibers, fibrils, or microfibers, or a desired surface area of a microfiber surface; or a combination thereof.

As a particular example, one microfiber material of a microfiber-entangled product could be selected to be hydrophilic while another microfiber material could be oleophilic. Using different types of materials in a microfiber-entangled product can produce a microfiber-entangled product or article having different properties, and that may be useful, for example, as a pad, a drape, a cloth-like wipe, a microfiber mat, or a large variety of other types of product that contain two or more different types of materials. This could be useful to make a wipe that is both water and oil absorbing.

The invention additionally allows for microfiber-entangled materials that include microfiber materials in combination with another material that is not a microfiber material, i.e., the second material is a "non-microfiber" material. These non-microfiber materials may be any material that can be combined or commingled with a microfiber material such that the microfibers of the microfiber material are entangled with the second, non-microfiber material. One or more of these second materials can be included in any of the microfiber-entangled products described, in combination with one or more microfiber materials.

A second material that is not a microfiber-material can be selected to provide a property or characteristic that is different from or complementary to properties of a microfiber-material. The non-microfiber-forming layer can be selected to give a certain physical or chemical property, such as hydrophobicity, hydrophilicity, etc., for its stain or water resistance, or a mechanical property such as rigidity, flexibility, elasticity. The microfiber-entangled product may exhibit a combination of properties including properties of a waterproof elastomer, and properties of microfiber surfaces, to give an article having combined properties of a flexible or stretchable microfiber-surface-bearing cloth. A complementary property may be one or more of the following: strength in a cross-web direction of the microfiber-material; a fibrous texture, perhaps including fibers or fibrils that are larger in size than microfibers; screens or textured materials or some other type of reinforcing material. Non-microfiber materials may have some feature that is either fibrous, such as a surface containing relatively larger fibrils (as opposed to microfibers, which are smaller), textured, or otherwise shaped or formed to allow microfibers to become entangled with the second material. Examples of general forms of useful such second materials include materials that are in the form of screens; meshes; open-cell foams; spunbonds; rovings of yarns or filaments; knit, woven, or non-woven (including dry laid, wet laid, spunbonded, and melt-blown) constructions; or any other feature of a size-scale that allows entanglement with a microfiber. Preferred materials can include reinforcing materials such as a scrim, screen, or a different woven or non-woven material or fabric, or a fiber-forming material.

A microfiber-entangled product that includes a second material that is a non-microfiber material can be prepared generally by contacting a microfiber material or a microfiber-forming material with the second material and then processing in a way that will cause entanglement of the second material with the microfibers. One method would be to contact a microfiber-forming film with the second material and then microfibrillate the materials to simultaneously form microfibers and entangle the microfibers with the second material. Alternatively, a microfiber material (already containing microfibers) may be contacted with the second material, and then the microfibers can be caused to entangle the second material, e.g., by hydroentangling.

As just one embodiment, a microfiber-entangled product may include a microfiber material and a fibrous material such as a woven or non-woven scrim or a screen that is entangled with microfibers from one or more microfiber materials. The microfiber-entangled product could be produced by contacting a microfiber material with the fibrous material and processing to cause entanglement of the microfibers and the fibrous material. Alternatively, a microfiber-forming material can be contacted with the fibrous material followed by formation of microfibers and entanglement. Microfiber material or microfiber-forming material may be brought in contact with the fibrous material by a variety of techniques including combining one or more fibers, tows, or webs of microfiber material or microfiber-forming material with one or more fibers, tows, or webs; dry laying, wet laying; spunbonding; or melt blowing fibers onto microfiber material or microfiber-forming material; and dry laying or wet laying microfiber material or microfiber-forming material onto fibrous material.

Microfiber materials, microfiber-forming materials, and other materials can be incorporated into a microfiber-entangled product by any methods that cause microfibers of a microfiber material to become entangled with a second material; optional methods can first microfibrillate a microfiber to produce microfibers and in the same process step also entangle the microfibers with a second material. Any processing methods that cause microfibers to become entangled with other microfibers or with a different type of a second material, can be useful. Various different methods for entanglement are known. Preferred methods involve microfibrillation and hydroentanglement.

The term "microfibrillation," as used herein, refers to methods of imparting energy to liberate microfibers from a microfiber-forming film. Such methods are well known in the art of processing extruded and co-extruded materials, and include methods of imparting a gaseous fluid using, for example, ultrasound techniques, and methods of imparting liquid fluids such as water, for example using high-pressure water jets. These methods are described generally with respect to the formation of microfibers, for example, in U.S. Pat. No. 6,110,588.

More specifically, a microfiber-forming film may be microfibrillated by imparting sufficient fluid energy to the surface to produce and at least partially release microfibers from the polymer matrix. Optionally, prior to microfibrillation, the film may be subjected to a fibrillation step by conventional mechanical means to produce macroscopic fibers from the highly oriented film, such as by the use of a rotating drum or roller having cutting elements such as needles or teeth in contact with the moving film. Other similar macrofibrillating treatments are known and include such mechanical actions as twisting, brushing (as with a porcupine roller), rubbing, for example with leather pads, and flexing.

The microfiber-forming film is microfibrillated by imparting sufficient fluid energy against a surface to impart a microfibrillated surface, for example, by contacting at least one surface of the film with a high-pressure fluid. The microfibers will typically have a rectangular cross section with a cross sectional aspect ratio (transverse width to thickness) ranging from about 1.5:1 to about 20:1, preferably from 3:1 to 9:1. Preferred microfibers can also have one or more of the following features or dimensions: an average effective diameter of from 0.01 to 10 microns, preferably of less than 5 microns; an average cross-sectional area of $0.5\mu^2$ to $3.0\mu^2$, preferably from about $0.7\mu^2$ to $2.1\mu^2$. Further, the sides of the rectangular shaped microfibers are not normally smooth, but have a scalloped appearance in cross section. Atomic force microscopy reveals that the microfibers are bundles of individual or unitary fibrils, which in aggregate form the rectangular or ribbon-shaped microfibers. Thus, the surface area exceeds that which may be expected from rectangular shaped microfibers. For example, preferred microfiber surfaces may exhibit a surface area of at least 0.25–15 square meters per gram, as measured using an Quantachrome AUTOSORB 1-KR gas sorption instrument (available from Quantachrome Corp., Boynton Beach, Fla.) with krypton adsorbate.

One method of microfibrillating a film surface is with fluid jets. In this process, one or more jets of a fine fluid stream impact the surface of a microfiber-forming film, which may be supported by a screen or moving belt, thereby releasing the microfibers from the polymer matrix. The degree of microfibrillation is dependent on the exposure time of the film to the fluid jet, the pressure of the fluid jet, the cross-sectional area of the fluid jet, the fluid contact angle, the polymer properties and, to a lesser extent, the fluid temperature.

Any type of liquid or gaseous fluid may be used. Liquid fluids may include water or organic solvents such as ethanol or methanol. Suitable gases such as nitrogen, air or carbon dioxide may be used, as well as mixtures of liquids and gases. Any such fluid is preferably non-swelling (i.e., is not absorbed by the polymer matrix), which would reduce the orientation and degree of crystallinity of the microfibers. Preferably the fluid is water.

The fluid temperature may be elevated, although suitable results may be obtained using ambient temperature fluids. The pressure of the fluid should be sufficient to impart some degree of microfibrillation to at least a portion of the film, and suitable conditions can vary widely depending on the fluid, the nature of the polymer, including the composition and morphology, configuration of the fluid jet, angle of impact and temperature. Typically, the fluid is water at room temperature and at pressures of at least 3400 kPa (500 psi), although lower pressure and longer exposure times may be used. Such fluid will generally impart a minimum of 5 watts or 10 $W/cm^2$ based on calculations assuming incompressibility of the fluid, a smooth surface and no losses due to friction.

The configuration of the fluid jets, e.g., the cross-sectional shape, may be nominally round, but other shapes may be used as well. The jet or jets may comprise a slot which traverses a section or which traverses the width of the film. The jets may be stationary, while the film is conveyed relative to the jets, the jets may move relative to a stationary film, or both the film and jet may move relative to each other. For example, the film may be conveyed in the machine (longitudinal) direction by means of feed rollers while the jets move transverse to the web. Preferably, a plurality of jets is employed, while the film is conveyed through the fibrillation chamber by means of rollers, while the film is supported by a screen or scrim, which allows the fluid to drain from the microfibrillated surface. The film may be microfibrillated in a single pass, or the film may be microfibrillated using multiple passes past the jets.

The jets may be configured such that all or part of the film surface is microfibrillated. Alternatively, the jets may be configured so that only selected areas of the film are microfibrillated. Certain areas of the film may also be masked, using conventional masking agents to leave selected areas free from microfibrillation. Likewise, the process may be conducted so that the microfibrillated surface penetrates only partially, or fully through the thickness of a single microfiber-forming layer of a multi-layer film, or fully or partially through one or more adjacent microfiber-forming layers of a multi-layer film. If it is desired that the microfibrillated surface extend through the thickness of the film, conditions may be selected so that the integrity of the article is maintained and the film is not severed into individual yarns or fibers.

A hydroentangling machine, for example, can be used to microfibrillate a surface by exposing the film to the fluid jets. Alternatively a pressure water jet, with a swirling or oscillating head, may be used, which allows manual control of the impingement of the fluid jet. Such machines are commercially available. Thus, a microfiber-entangled product may be efficiently produced by placing a microfiber-forming material in contact with another microfiber-forming material or a second material, which may be a microfiber material, a fibrous material, a scrim or screen, or any other of the second materials described herein, and microfibrillating the microfiber-forming film using a hydroentangling machine to form microfibers, wherein the microfibers will become entangled with the second material.

Of course a hydroentangling machine may be used for entangling microfibers that are already present on a microfiber material. Accordingly, a microfiber-entangled product may be produced by placing a microfiber material in contact with another microfiber material or a second material, and hydroentangling the microfibers with a hydroentangling machine.

Microfibrillation or entanglement may be accomplished by other methods as well, as will be understood by the skilled artisan, e.g., by immersing a microfiber material or a microfiber-forming material in a high energy cavitating medium, e.g., and achieving cavitation by applying ultrasonic waves to the fluid. The rate of microfibrillation is dependent on the cavitation intensity. Ultrasonic systems can range from low acoustic amplitude, low energy ultrasonic cleaner baths, to focused low amplitude systems up to high amplitude, high intensity acoustic probe systems.

In the microfibrillation process, whatever type is chosen, most of the microfibers preferably stay attached to the microfiber-forming material (now the microfiber material) due to incomplete release of the microfibers from the polymer matrix.

If desired, adjuvants may be added to the polymer melt to improve the microfibrillation efficiency, such as silica, calcium carbonate or micaceous materials or to impart a desired property to the microfibers, such as antistats or colorants. Further, nucleating agents may be added to control the degree of crystallinity or, when using polypropylene, to increase the proportion of β-phase polypropylene in the crystalline film. A high proportion of β-phase is believed to render the crystalline film more readily microfibrillated. β-phase nucleating agents are known and are described, for example, in Jones, et al., Makromol. Chem., vol. 75, 134–158 (1964) and J. Karger-Kocsis, Polypropylene: Structure, Blends and Composites, vol. 1, 130–131(1994). One such beta nucleating agent is N',N',-dicyclohexyl-2,6-napthalene dicarboxamide, available as NJ-Star NU-100ä from New Japan Chemical Co. Chuo-ku, Osaka. Japan.

The microfibrillated film can be formed into any of a number of different useful end constructions. A couple of examples include cloths or cloth-like materials, e.g., for cleaning; tape backings; filter materials; fibrous mats, thermal and acoustical insulation, single use wipes, adhesive bandages, dielectric strain relief layers for electronic multilayer assemblies or antenna, composite reinforcement structures, absorptive materials, etc.

EXAMPLES

Test Method I—Thickness Measurement

A model M034A Digital Thickness Gauge (available from SDL America Inc., Charlotte, N.C.) was used to determine the thickness of microfibrillated films and microfibrillated film seams. The pressure foot was elevated, and the sample was placed on the platform. The measuring platform was zeroed, using the zero control knob under the digital display. The sample was removed, and the indicator showed a negative value. Using the fast speed, the pressure foot was lowered until it was approximately 2 mm above the measuring platform. The speed was switched to slow, and the pressure foot was lowered, using the joystick, until it came into contact with the platform and a pressure of 20 grams was displayed. The digital height gauge was then zeroed. The sample thickness was then measured by raising the pressure foot, placing the sample on the platform, lowering the foot using the slow speed until a pressure of 20 grams was obtained, and reading the thickness from the digital height gauge.

Test Method II—Tensile Strength Measurement

A Model UTSE-2 CHATILLON™ motorized test stand/force gauge (available from John Chatillon & Sons, Inc., Force Measurement Div., Greensboro, N.C.) was used to determine the tensile strength of samples with and without a seam. Samples were place lengthwise and centered in the grips with a 5.08 cm gap between the grips. A cross-head speed of 25.4 cm/minute was used. The maximum load and elongation at break were recorded. Three samples were tested, and the mean values for maximum load and elongation were reported.

Film Casting Method

Polypropylene resins (FINA 3374, a polypropylene homopolymer, or FINA 3376, both available from Fina Inc., Dallas, Tex.) were used. The 3374 was used with 0.1 weight % Hostaperm Red E3B (PV 19), an γ-quinacridone (CAS No. 1-047-16-1, available from Clariant GmbH, Frankfurt, Germany). Resin was extruded into films using a single screw extruder with either a Cloeren die or a single layer die. The Cloeren die was 12.7 cm wide with an orifice gapped to a nominal 2.54 mm, and the single layer die was 121.9 cm wide with an orifice gapped to a nominal 1.78 mm. The polypropylene was fed from the die into the nip of the bottom and middle rolls of a vertical, 3-roll stack casting line. Nip gaps and roll pressures were set to provide a cast film, exiting the nip of the middle and top rolls, with a thickness of 0.76, 1.27, or 1.68 mm. Roll temperatures were set at either 93.3° C. or 98.9° C.

Film Orienting and Voiding Methods

Method A—Cast films were fed from an unwind station into the compressive nip of a first calender (two rolls) at a surface speed of 1.22 m/min, a temperature of 149° C., and a pressure of 2.76 MPa. The film exiting the first calender was fed into a second and third pulling calender set (two rolls in each set) operating at as high a surface speed as possible without breaking the film. The resulting oriented and voided film was wound onto a core under tension.

Method B—Cast films were fed to the surface of the first roll of an s-wrap type calender using the SIGNODE process. The film was fed into the nip of the first roll and a second roll operating at a higher surface speed than the first roll. The gap between the first and second rolls was either 0.0762 mm or 0.152 mm. The film was then fed to a third roll operating at a higher surface speed than the second roll. The first two rolls calendered and sheared the film, and the third roll, additionally, stretched the film. Temperatures and surface speeds of the rolls were as follows:

| Roll | Surface Speed (m/min) | Temperature (° C.) |
|---|---|---|
| First | 1.28 | 130 |
| Second | 8.63 | 120 |
| Third | 18.9 | 140 |

The resulting oriented and voided film was wound onto a core under tension.

The draw ratios of the oriented and voided films made by either Method A or B were calculated by dividing (density×width×thickness) of the cast film by (density×width×thickness) of the oriented and voided film.

Hydroentangling Method

Hydroentangling was done by subjecting oriented films to high pressure water jets, causing microfibrillation of the films and entanglement of microfibers between film surfaces, edges, and surfaces and edges to form strong structures without binder. A HYDROLACE 350 SYSTEM™ (available from CEL INTERNATIONAL LTD., Coventry, England), operated at a system water pressure of 15 MPa, and equipped with 7 water injector heads, was used to hydroentangle the films. Each injector head was configured with a jet strip having 16.5 holes/cm, with each hole dimensioned 120μ by 15.2 μ. The injector heads were 0.5 m in length and were mounted four above and three below an open-mesh conveyor perpendicular to the direction of the conveyor; so that each sample passed through the system was subjected to output from all injector heads, with 4.5 $m^3$ of water delivered from each head. Unless otherwise indicated, a conveyor speed of 2.5 m/min. was used.

Narrow Width Slitting Method

Narrow width slitting was done using a Razor/Score Slitter, Model 325B17 (manufactured by Arrow Converting Equipment Inc., Fairfield, N.J.), having a machine width of 0.45 m and a slitting width capability of 0.0806 mm to 11.29 mm. The slitter was equipped with 26 razor blades spaced 0.0806 mm apart. The film was passed through the slitter with a line tension of 1.45 MPa a line speed of 1.5 m/min., and the resulting 24 individual 0.806 mm wide strips were collected onto a core by hand.

Example 1

Figure 22:
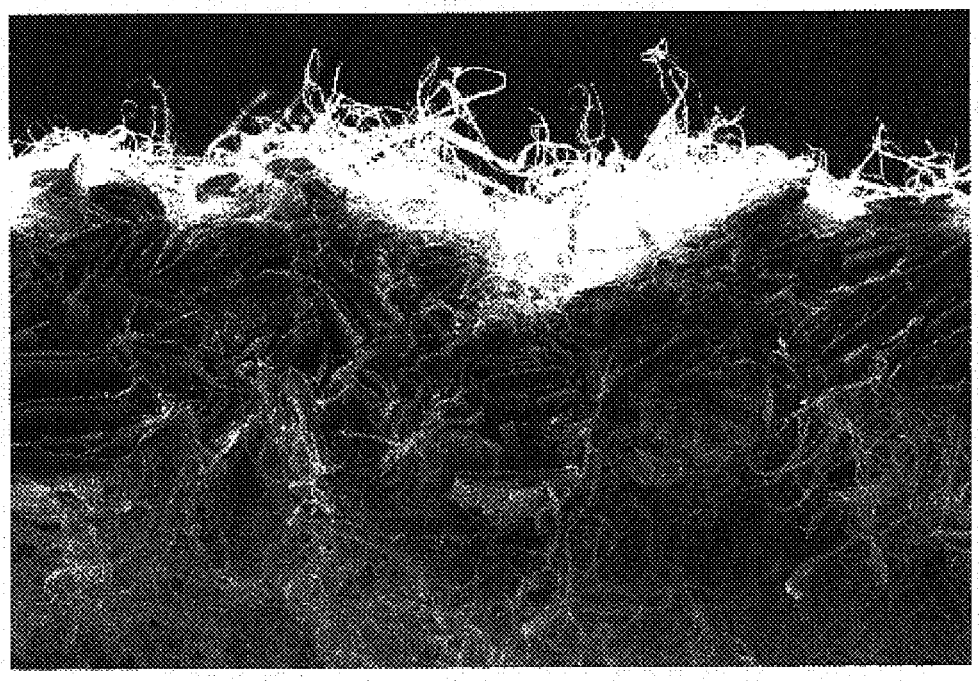
FIG. 22 is an SEM of a cross-section of a seam area of a microfiber-entangled seam such as that of FIG. 9.
Figure 23:
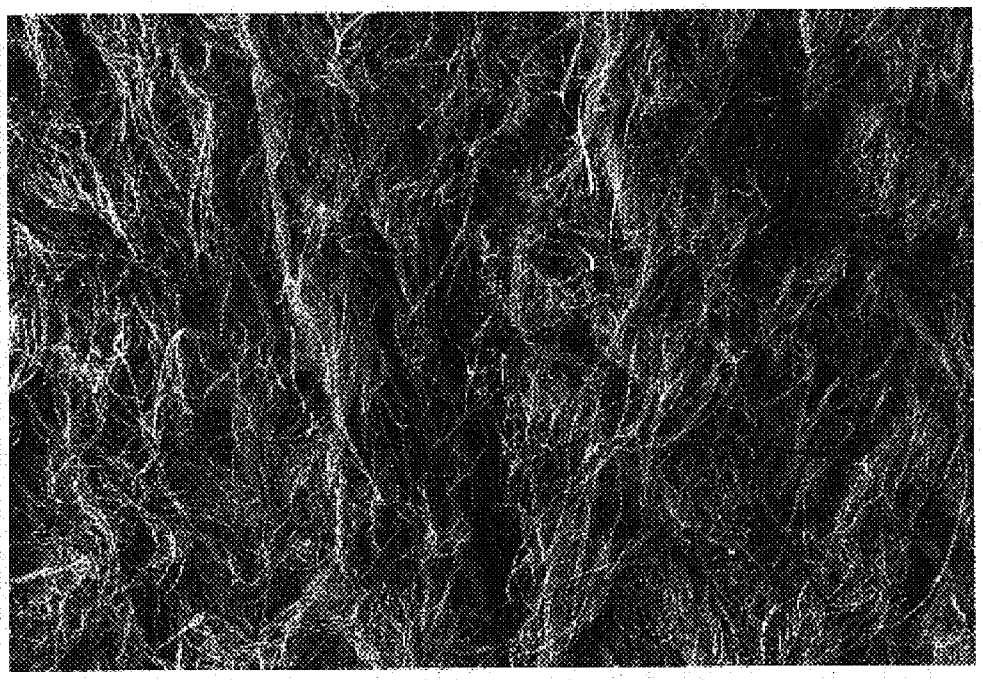
FIG. 23 is an SEM of a top surface of a seam area of a microfiber-entangled seam such as that of figure of FIG. 22.
Figure 24:
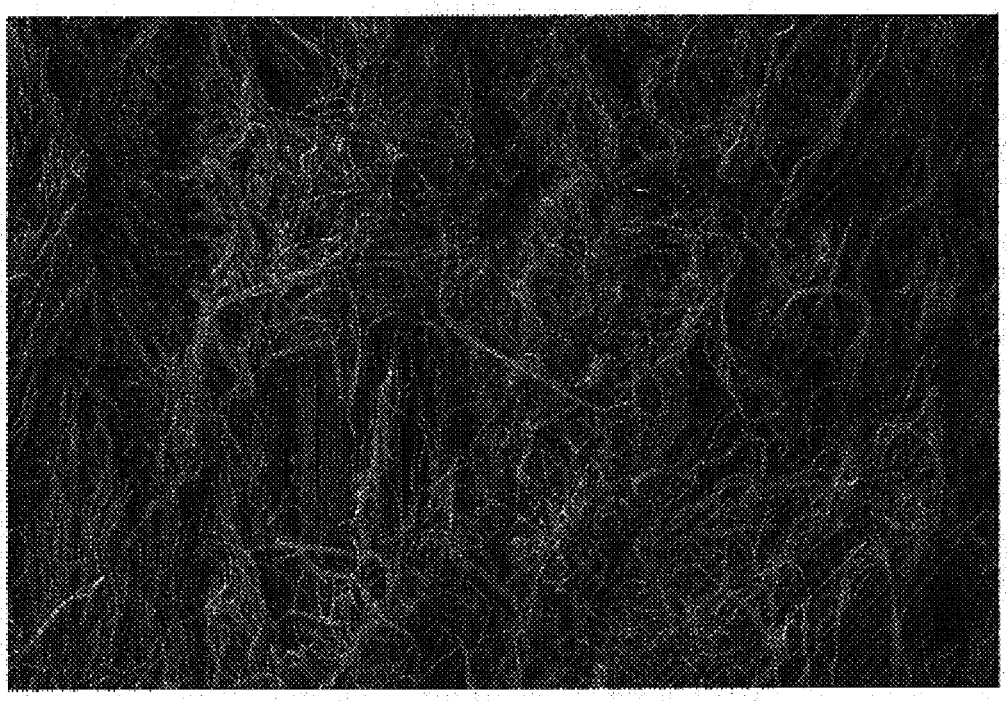
FIG. 24 is an SEM of a bottom surface of a seam area of a microfiber-entangled seam such as that of FIG. 9 or FIG. 22.

This Example demonstrates the joining of two films without a visible seam by hydroentangling films with edge to edge contact. Thus, a highly oriented, microvoided film, made by the *Film Orienting and Voiding Method A* (using a 1.68 mm thick cast film produced from FINA 3374 polypropylene (containing 0.1 weight % Red E3B) by the *Film Casting Method* with 98.9° C. casting rolls), and having a thickness of 0.15 mm, a width of 4.1 cm, a density of 0.733 g/mL, a calculated void content of 18.6%, and a calculated extension ratio of 20.7:1, was cut into two samples having lengths of 4.57 m. The samples were clamped together lengthwise, edge to edge, and subjected to the *Hydroentangling Method* described above. The resulting sample was found to be comprised of the two original samples entangled by microfibers originating from each of the samples. This sample was given an additional pass through the hydroentangling system, resulting in a uniformly fibrillated sample without a visible seam. The seam is shown in FIGS. 22, 23, and 24. Thicknesses of the sample in the seam area and the non-seam areas were determined using Test Method I. A thickness of 0.56 mm was found in all areas tested. Test strips (2.54 cm×10.16 cm) were cut from the sample from the areas on each side of the seam and from the combined areas including the seam crossing the center of the test strips. The tensile and elongation properties of the test strips were determined using Test Method II and the results are shown in Table 1.

TABLE 1

Tensile and Elongation Properties of Test Strips With and Without Entangled Seam

| Test Strip | Maximum Load (N) | Elongation (%) |
|---|---|---|
| Area Left of Seam | 1.82 | 109.5 |
| Area Right of Seam | 1.95 | 122.1 |
| Area Including Seam | 1.85 | 109.8 |

The results in Table 1 show that the seam had essentially the same tensile and elongation properties as the other areas of the sample tested.

Example 2

This Example demonstrates the formation of a dimensionally stable microfibrillated fabric by hydroentangling woven films. Thus, a first highly oriented, microvoided film made with FINA 3374 polypropylene essentially as described in Example 1, but having a width of 7.62 cm, was slit into strips having a width of 12.7 mm, using two razor blades mounted parallel to each other and spaced 12.7 mm apart. A second, highly oriented, microvoided film, made by the *Film Orienting and Voiding Method B* (using a 0.76 mm thick cast film produced from FINA 3376 polypropylene by the *Film Casting Method* with 93.3° C. casting rolls), and having a thickness of 0.10 mm, a width of 11.4 cm, a density of 0.792 g/mL, a calculated void content of 12%, and a calculated extension ratio of 16.3:1, was similarly slit into strips having a width of 12.7 mm. The first and second film strips were woven together by hand with the first film strips in the weft (cross direction) and the second film strips in the warp (machine direction). See FIG. 10. The resulting woven sample was subjected to the *Hydroentangling Method*. After one pass, microfibers from the edges of the strips were entangled with microfibers from adjacent strips. The woven sample was subjected to five additional passes through the hydroentangling system, alternating the side facing the four injector heads. The resulting completely fibrillated fabric was stable in both weft and wrap directions and was observed to be seamless. See FIG. 11.

Example 3

This Example demonstrates the formation of a dimensionally stable microfibrillated sheet from two film layers. The highly oriented, microvoided film made with FINA 3374 polypropylene essentially as described in Example 1, but having a width of 5.08 cm, was cross-lapped by spiraling the film around itself at an angle of 30° and flattening the spiraled film. The machine direction of the opposing layers of the resulting two-layer sheet were approximately perpendicular to each other. See FIG. 12. The sheet was subjected to the hydroentangling method described above. Microfibers from adjoining edges within the resulting microfibrillated sheet were found to be entangled. The microfibrillated sheet was subjected to five additional passes through the hydroentangling system, alternating the side facing the four injector heads. The resulting completely fibrillated fabric sheet was stable in both length and width directions and was observed to be seamless. See FIG. 13.

Example 4

Figure 14:
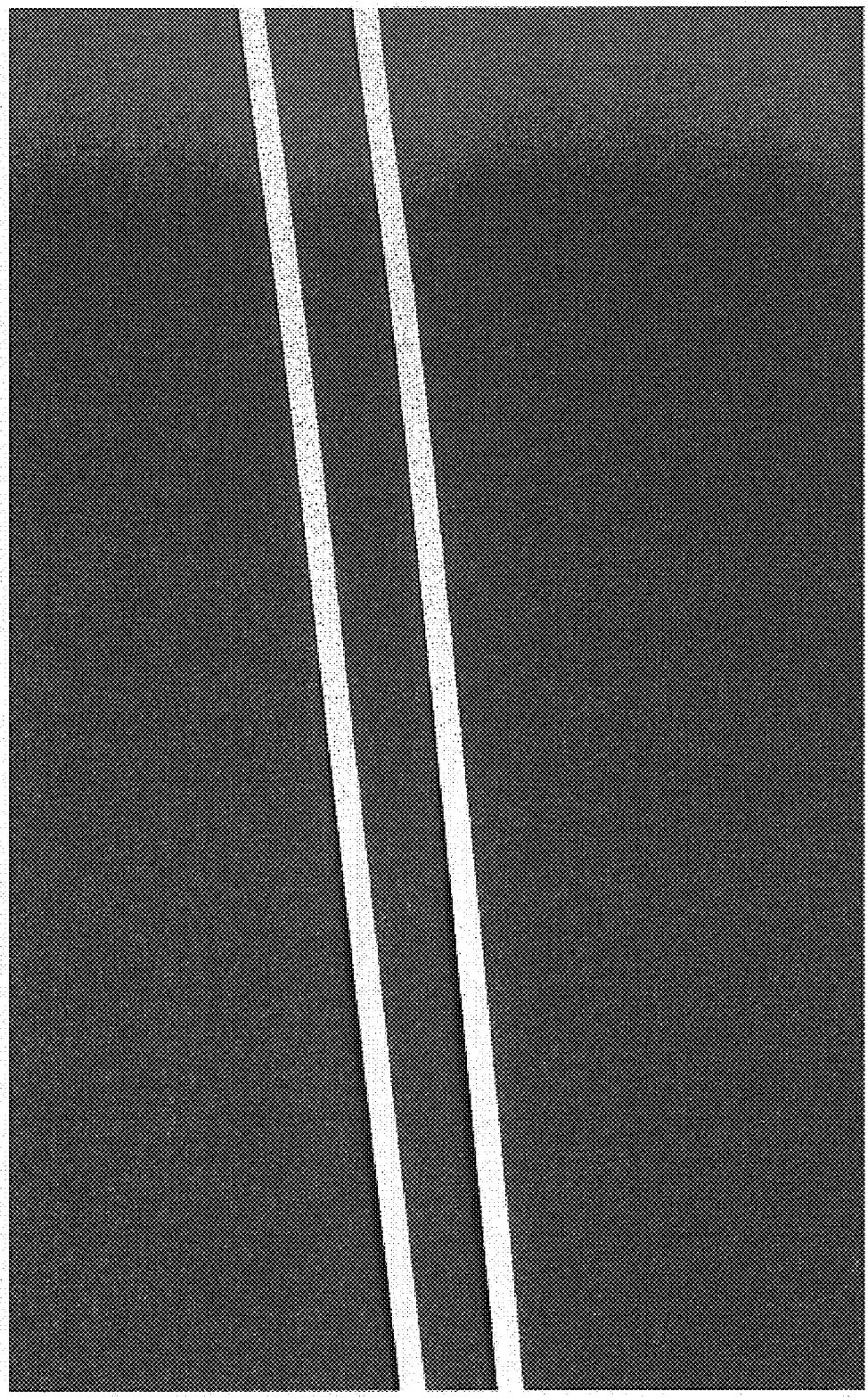
FIG. 14 is a photograph of separate narrow films before twisting or hydroentangling.
Figure 15:
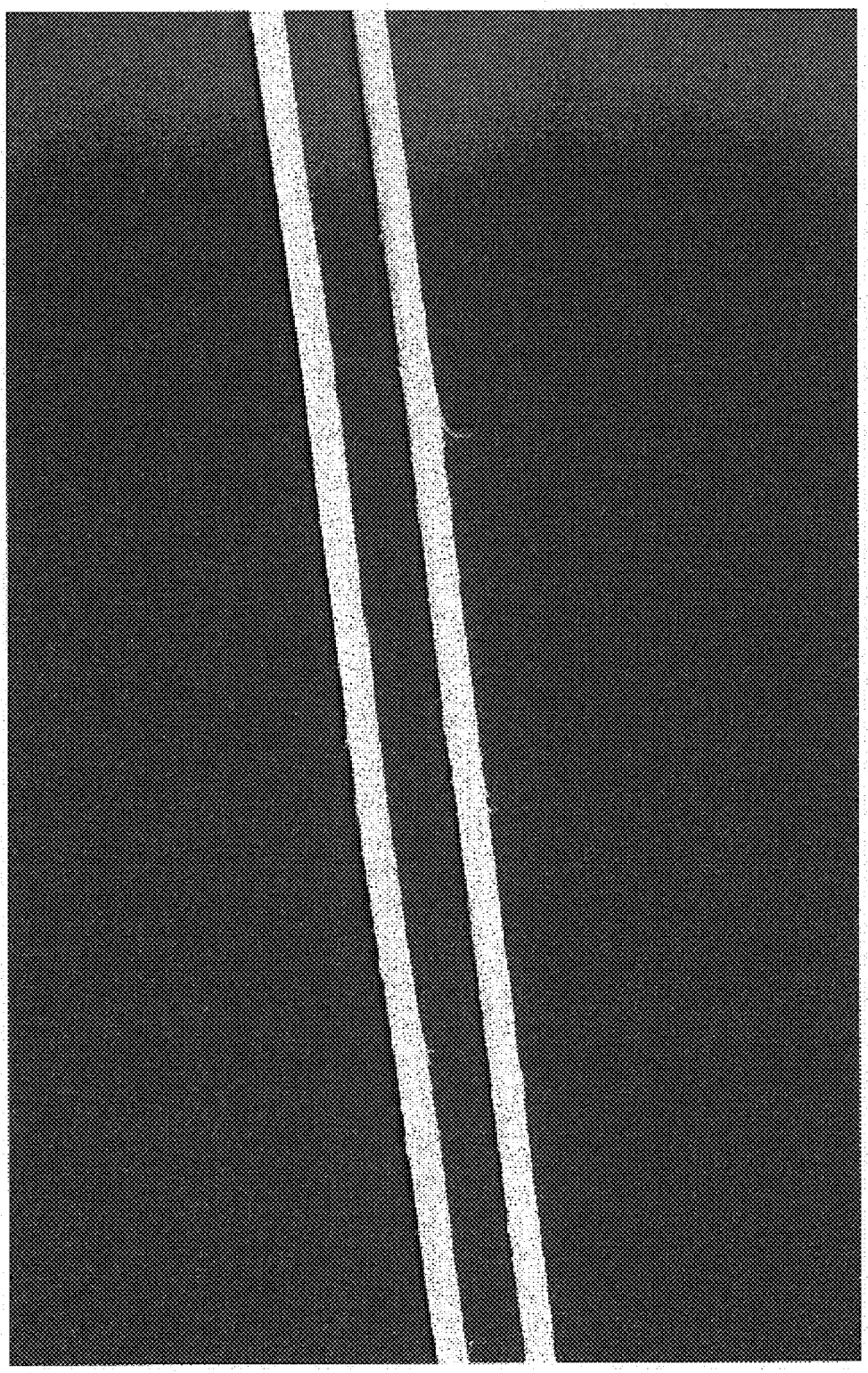
FIG. 15 is a photograph of separate narrow films after microfibrillation.
Figure 16:
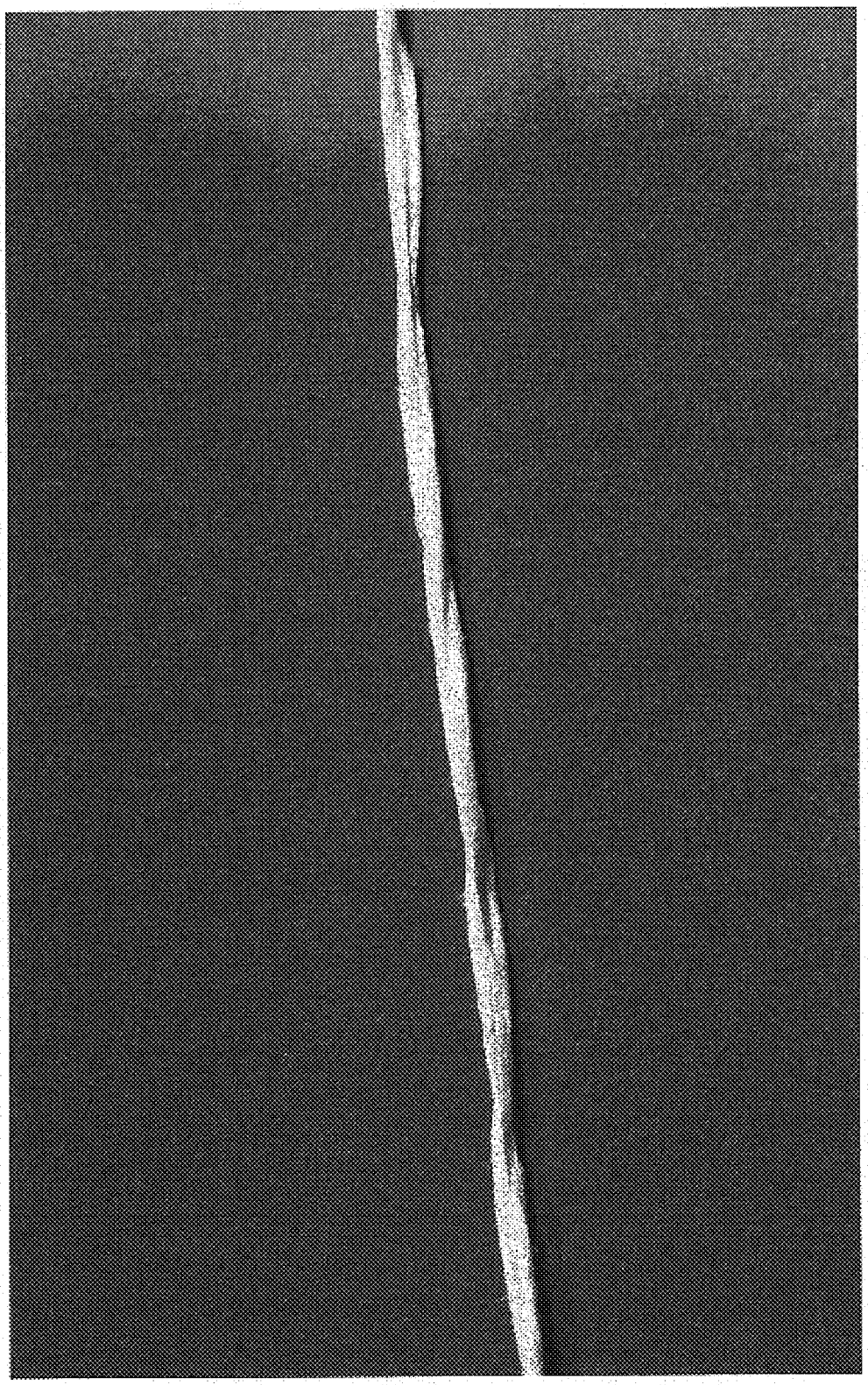
FIG. 16 is a photograph of microfibrillated narrow films after twisting together.

This Example demonstrates the formation of a yarn or rope by twisting together microfibrillated films. Thus, a highly oriented, microvoided film made with FINA 3376 polypropylene essentially as described for the second film of Example 2, but having a width of 7.62 cm, was slit into strips using the Narrow Width Slitting Method. See FIG. 14. Several of the strips were separately subjected to the Hydroentangling Method. After one pass through the hydroentangling system, the strips were partially microfibrillated, and after two passes a more uniform microfibrillation was achieved. See FIG. 15. Two of the resulting microfibrillated strips were twisted by hand in the S-direction until 1.5 twists per 2.54 cm of strip length was achieved. The resulting twisted, microfibrillated strips were twisted together by hand in the Z-direction until 1.5 twists per 2.54 cm of length was achieved. See FIG. 16.

Example 5

Figure 17:
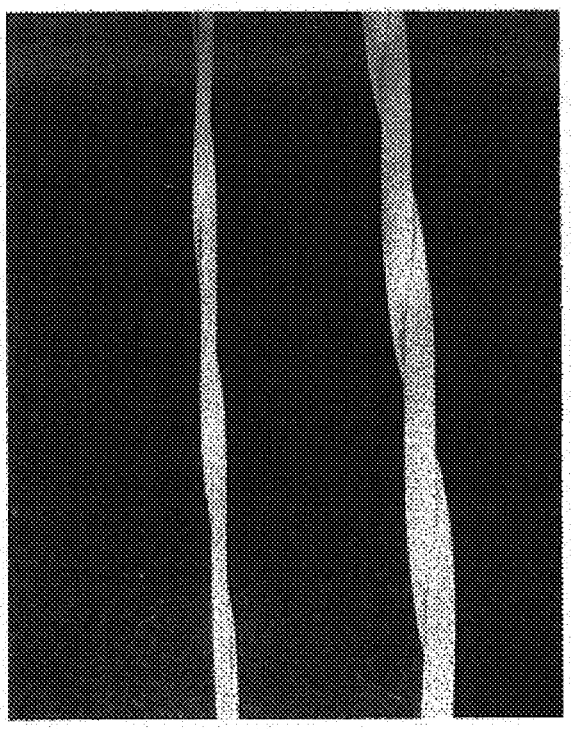
FIG. 17 is a photograph of narrow films after twisting together.
Figure 18:
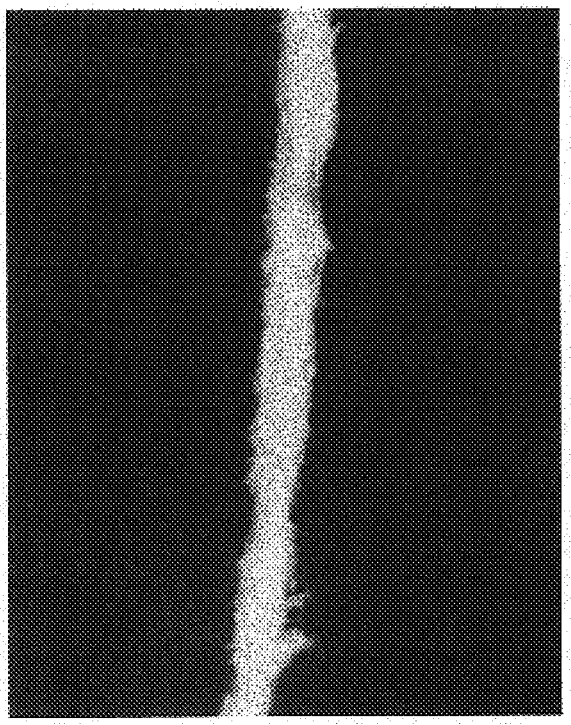
FIG. 18 is a photograph of narrow films twisted together and then hydroentangled.

This Example demonstrates the formation of a yarn or rope by microfibrillating films twisted together. Two unmicrofibrillated strips of Example 4 were twisted individually and together as in Example 4. See FIG. 17. The resulting twisted, double strip was subjected to the Hydroentangling Method as in Example 4. The individual strips of the resulting microfibrillated twisted double strip were no longer clearly visible. See FIG. 18.

Example 6

Figure 19:
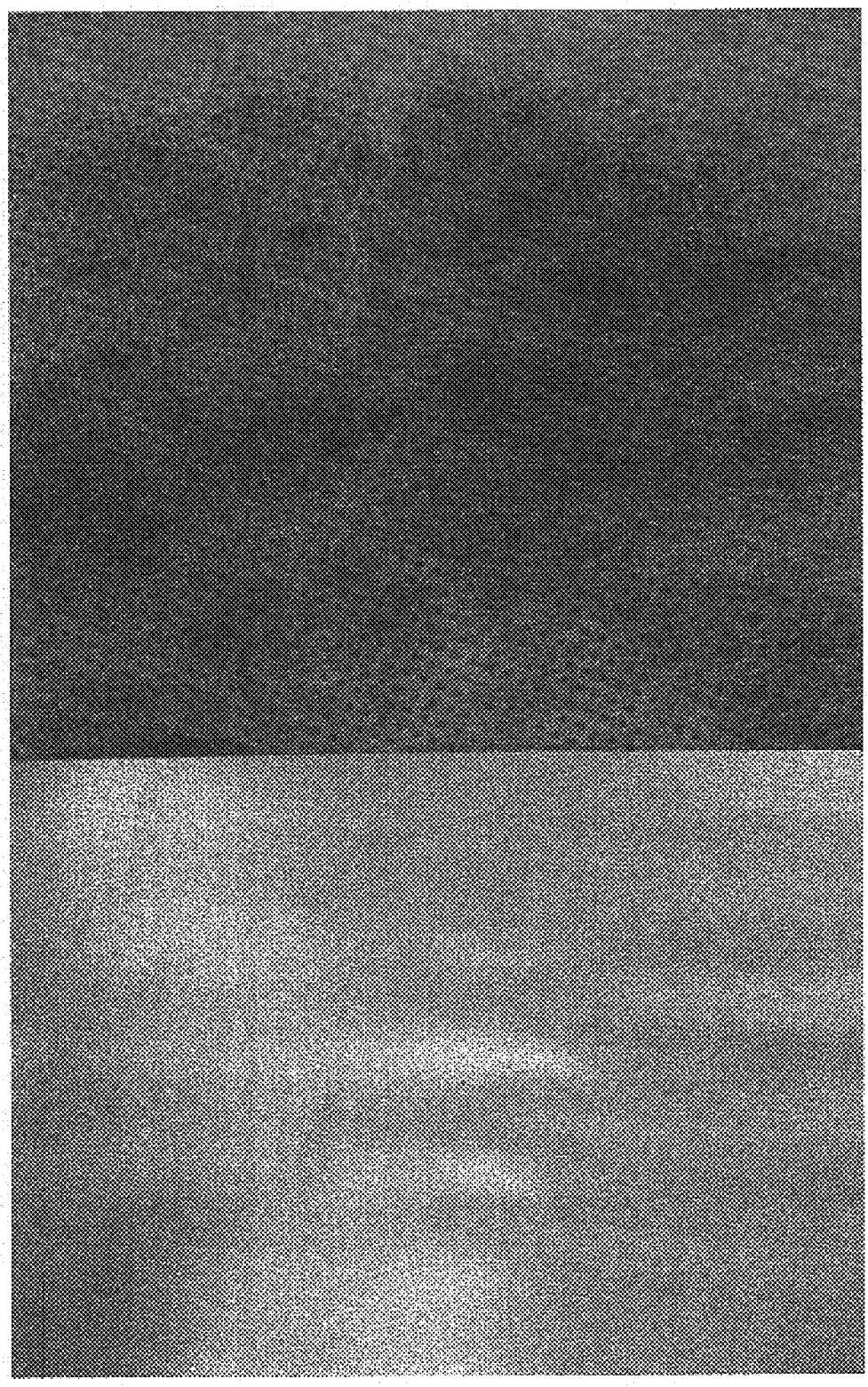
FIG. 19 is a photograph of film of a microfiber-forming film over a non-microfiber nonwoven before hydroentangling.
Figure 20:
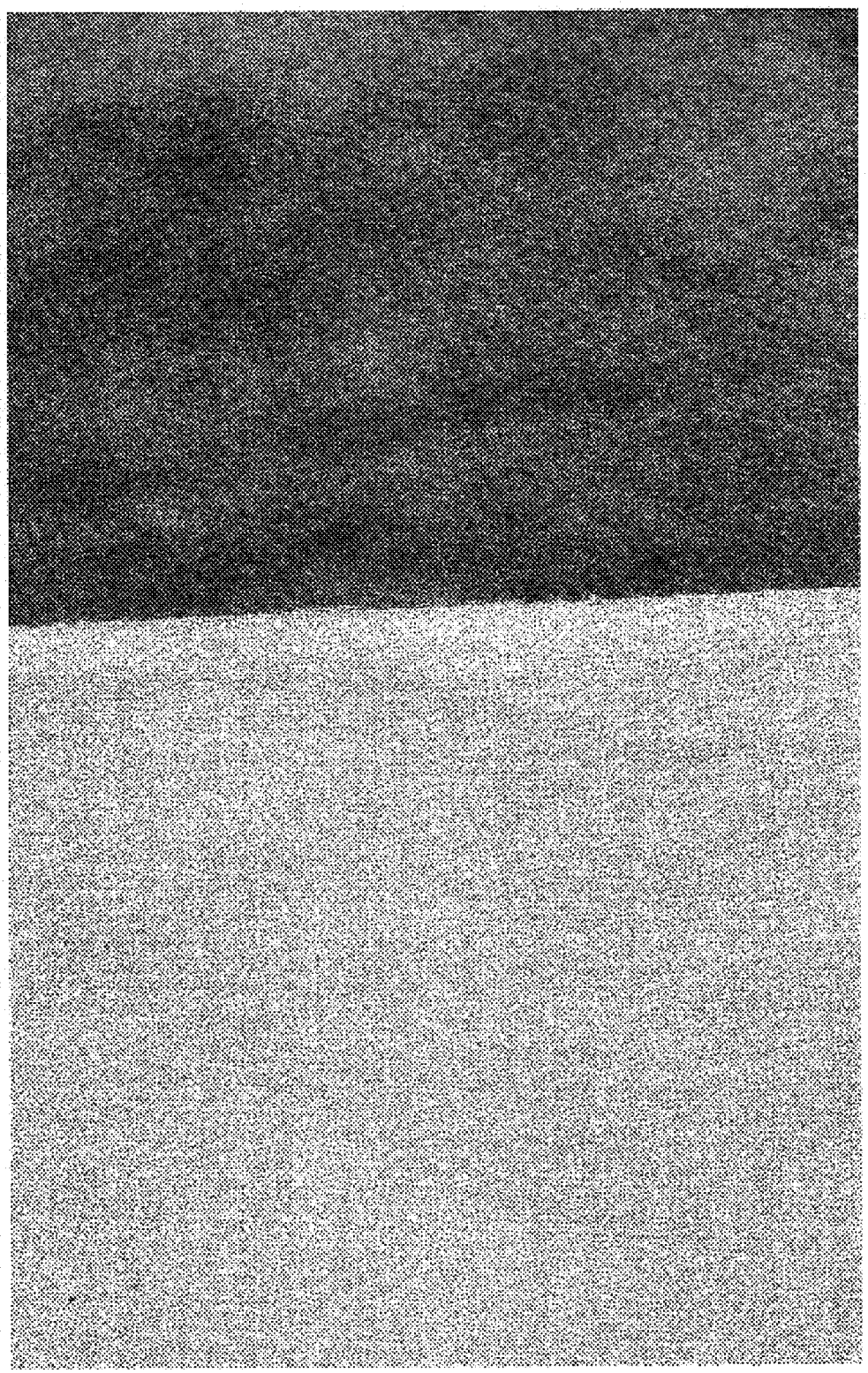
FIG. 20 is a photograph of film of a microfiber film entangled with a non-microfiber nonwoven after hydroentangling.
Figure 21:
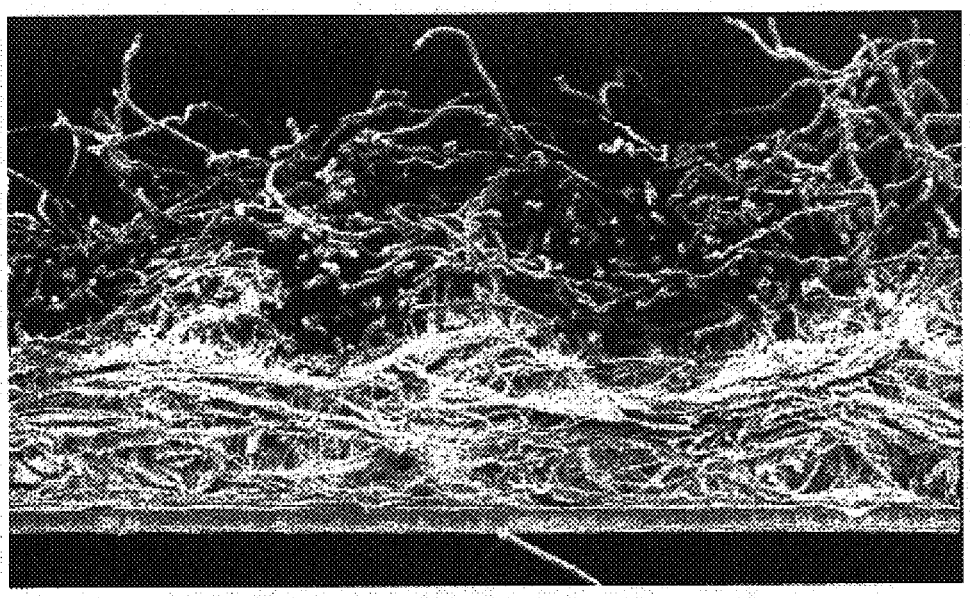
FIG. 21 is an SEM of a cross-section of a microfibrillated film entangled with a non-microfiber nonwoven.

This Example demonstrates the formation of a hybrid material by microfibrillating a film in contact with a non-microfiber nonwoven. A 4.57 m by 5.08 cm piece of highly oriented, microvoided film used in Example 3 was placed on top of a portion of a larger piece of spunbond polypropylene nonwoven (AVGOL™, 1.5 denier, 30 g/m$^2$, available from Avgol Nonwoven Industry, Avgol LTD., Holon, Israel). See FIG. 19. The combined film and nonwoven was subjected to the Hydroentangling Method, resulting in some microfibrillation through the film and some entanglement of the microfibers with the nonwoven. After a second pass through the hydroentangling system complete microfibrillation and entanglement with the nonwoven was achieved. See FIG. 20. FIG. 21 shows a cross-sectional view of the hydroentangled article, which depicts an upper section of fibrils from the non-woven material entangled with a lower portion of microfibers.

What is claimed is:

1. A microfiber-entangled product comprising a microfiber material having oriented microfibers entangled with a second material, wherein the oriented microfibers have an average effective diameter of less than 20 microns and a transverse aspect ratio of from 1.5:1 to 20:1.

2. The product of claim 1 wherein the second material is a microfiber material comprising oriented microfibers.

3. The product of claim 1 comprising microfibers of one portion of microfiber material entangled with microfibers of a second portion of microfiber material.

4. The product of claim 3 wherein the portions of microfiber material are different portions of the same microfiber film.

5. The product of claim 4 comprising a single piece of microfiber film folded so an edge portion of the film contacts a surface portion of the film, wherein microfibers of the edge portion are entangled with microfibers of the surface portion.

6. The product of claim 2 comprising an edge of a first microfiber film joined to an edge of a second microfiber film.

7. The product of claim 6 wherein edges of the microfiber films rejoined at a seam comprising microfibers from the different microfiber films entangled at the seam, and wherein the seam is difficult to detect visually.

8. The product of claim 2 comprising two or more microfiber films, each having opposed major surfaces, wherein a major surface of one film contacts a major surface of the other film, and oriented microfibers originating from an edge of one film are entangled with oriented microfibers originating from a surface of another film.

9. The product of claim 8 comprising multiple strips of microfiber films ranged in a substantially perpendicular, woven fashion.

10. The product of claim 1 wherein the second material does not comprise microfibers.

11. The product of claim 10 wherein the second material is a non-microfiber material having a feature that can be entangled with the microfibers, the feature selected from the group consisting of a fibrous feature, a surface texture, and a shape.

12. The product of claim 10 wherein the second material is selected from the group consisting of a screen, a mesh, a spunbond material, a knit material, a woven material, a non-woven material, and a fibrous material.

13. The product of claim 10 wherein the second material is selected from the group consisting of a scrim and a fibrous fabric.

14. A microfiber-entangled product comprising a microfiber material and a second material, the microfiber material and the second material being twisted, braided, tied, or entwined, wherein microfibers of the microfiber material are entangled with the second material wherein the microfiber material comprises oriented microfibers and wherein the oriented microfibers have an average effective diameter of less than 20 microns and a transverse aspect ratio of from 1.5:1 to 20:1.

15. The product of claim 14 wherein the product is chosen from the group consisting of a thread, a ribbon, a yarn, a string, a fabric, a rope, and a twine.

16. The product of claim 14 wherein the second material is chosen from the group consisting of wool, cotton, polyester, rayon, and combinations thereof.

17. The product of claim 14 wherein the oriented microfibers have an average effective diameter of from 0.01 to 10 microns.

18. The product of claim 14 wherein the oriented microfibers have an average cross-sectional area of 0.5 $\mu^2$ to 3.0 $\mu^2$.

19. The product of claim 14 wherein the oriented microfibers have an avenge cross-sectional area of 0.7 $\mu^2$ to 2.1 $\mu^2$.

20. The product of claim 1 wherein the oriented microfibers have an average effective diameter of from 0.01 to 10 microns.

21. A microfiber-entangled product comprising a microfiber material having oriented microfibers entangled with a second material, wherein the oriented microfibers have an average cross-sectional area of 0.5 $\mu^2$ to 3.0 $\mu^2$.

22. A microfiber-entangled product comprising a microfiber material having oriented microfibers entangled with a second material, wherein the oriented microfibers have an average cross-sectional area of 0.7 $\mu^2$ to 2.1 $\mu^2$.

* * * * *